US011202486B2

(12) United States Patent
Lee et al.

(10) Patent No.: US 11,202,486 B2
(45) Date of Patent: Dec. 21, 2021

(54) PROTECTIVE FOOTWEAR

(71) Applicant: Fox Head, Inc., Irvine, CA (US)

(72) Inventors: Andre Lee, Irvine, CA (US); Luis Cosio, Irvine, CA (US); David Durham, San Clemente, CA (US); David Munn, Irvine, CA (US)

(73) Assignee: Fox Head, Inc., Irvine, CA (US)

( * ) Notice: Subject to any disclaimer, the term of this patent is extended or adjusted under 35 U.S.C. 154(b) by 178 days.

(21) Appl. No.: 16/041,472

(22) Filed: Jul. 20, 2018

(65) Prior Publication Data

US 2019/0021446 A1 Jan. 24, 2019

Related U.S. Application Data

(60) Provisional application No. 62/535,721, filed on Jul. 21, 2017.

(51) Int. Cl.

| | |
|---|---|
| ***A43C 11/16*** | (2006.01) |
| ***A43C 11/14*** | (2006.01) |
| ***A43B 7/08*** | (2006.01) |
| ***A43B 7/32*** | (2006.01) |
| ***A43B 5/14*** | (2006.01) |
| *A43B 5/04* | (2006.01) |
| *A43C 9/08* | (2006.01) |

(52) U.S. Cl.

CPC ..... *A43C 11/16* (2013.01); *A43B 5/145* (2013.01); *A43B 7/08* (2013.01); *A43B 7/32* (2013.01); *A43C 11/1406* (2013.01); *A43B 5/04* (2013.01); *A43C 9/08* (2013.01)

(58) Field of Classification Search

CPC .. A43B 5/145; A43B 7/08; A43B 7/32; A43B 5/04; A43B 5/00; A43B 5/0401; A43B 5/0429; A43B 5/0433; A43B 5/0435; A43B 5/0437; A43B 5/0482; A43B 5/049; A43B 7/06; A43B 7/084; A43B 7/085; A43B 7/082; A43B 7/10; A43C 11/16; A43C 11/1406; A43C 9/08

USPC ... 36/3 A, 117.1, 117.2, 117.7, 117.8, 118.1, 36/50.5

See application file for complete search history.

(56) References Cited

U.S. PATENT DOCUMENTS 3,410,006 A * 11/1968 Vogel ..... A43B 13/12 36/3 R
4,611,414 A * 9/1986 Vogel ..... A43B 5/0441 280/613

(Continued)

FOREIGN PATENT DOCUMENTS

DE 2414439 A1 * 10/1975 ..... A43C 11/008
EP 2591696 A1 5/2013

(Continued)

*Primary Examiner* — Jameson D Collier

(57) ABSTRACT

A protective footwear includes a foot engagement portion, a lower-leg engagement portion, and a cable closure system. The lower-leg engagement portion defines a cable end interface and a buckle interface. The cable closure system is configured to facilitate at least partially securing the protective footwear to a leg of a wearer. The cable closure system includes a buckle assembly configured to releasably couple to the buckle interface and a cable extending between the cable end interface and the buckle assembly. The cable has a first end coupled to the cable end interface and an opposing second end coupled to the buckle assembly.

17 Claims, 28 Drawing Sheets

(56) References Cited

U.S. PATENT DOCUMENTS

| | | | | | |
|---|---|---|---|---|---|
| 4,905,384 | A * | 3/1990 | De Marchi | A43B 5/0415 | 36/118.9 |
| 5,459,949 | A * | 10/1995 | MacPhail | A43B 5/00 | 36/117.1 |
| 5,713,587 | A * | 2/1998 | Morrow | A43B 3/0073 | 280/14.21 |
| 6,233,845 | B1 * | 5/2001 | Belli | A43B 1/00 | 36/2.6 |
| 6,401,364 | B1 * | 6/2002 | Burt | A43B 1/00 | 36/3 A |
| 9,027,261 | B2 * | 5/2015 | Mazzarolo | A43B 7/06 | 36/131 |
| 2011/0067271 | A1 | 3/2011 | Foxen et al. | | |
| 2012/0090196 | A2 | 4/2012 | Mazzarolo et al. | | |
| 2012/0256381 | A1 | 10/2012 | Bradshaw | | |
| 2013/0086818 | A1 | 4/2013 | Donnadieu | | |
| 2013/0180133 | A1 | 7/2013 | Delladio | | |
| 2014/0215855 | A1 | 8/2014 | Frey | | |
| 2014/0259766 | A1 * | 9/2014 | James | A43C 11/08 | 36/83 |
| 2016/0278948 | A1 | 9/2016 | Piercy et al. | | |

FOREIGN PATENT DOCUMENTS

| | | | |
|---|---|---|---|
| EP | 3195753 | A1 | 7/2017 |
| IT | UB20160338 | A1 | 7/2017 |

* cited by examiner

PROTECTIVE FOOTWEAR

CROSS-REFERENCE TO RELATED APPLICATIONS

This application claims priority to U.S. Provisional Application No. 62/535,721, entitled "PROTECTIVE FOOTWEAR", filed on Jul. 21, 2017, the entirety of which is incorporated by reference herein in its entirety.

BACKGROUND

Protective footwear such as action sports boots may be used to provide protection to a wearer from flying debris, during crashes, during falls, etc. while participating in action sports. Conventionally, such protective footwear have a relatively high stiffness that limits anatomical movement of a wearer's foot and lower leg, restricting the wearer's agility and ability to maneuver. The limited range of movement may tend to cause premature fatigue of the wearer.

SUMMARY

One embodiment relates to a protective footwear. The protective footwear includes a foot engagement portion, a lower-leg engagement portion, and a cable closure system. The lower-leg engagement portion defines a cable end interface and a buckle interface. The cable closure system is configured to facilitate at least partially securing the protective footwear to a leg of a wearer. The cable closure system includes a buckle assembly configured to releasably couple to the buckle interface and a cable extending between the cable end interface and the buckle assembly. The cable has a first end coupled to the cable end interface and an opposing second end coupled to the buckle assembly.

In some embodiments, the foot engagement portion defines a second cable end interface and the lower-leg engagement portion or the foot engagement portion defines a second buckle interface.

In some embodiments, the protective footwear includes a second cable closure system configured to facilitate at least partially securing the protective footwear to the leg of the wearer. The second cable closure system includes a second buckle assembly configured to releasably couple to the second buckle interface; and a second cable extending between the second cable end interface and the second buckle assembly. The second cable includes a first end coupled to the second cable end interface and an opposing second end coupled to the second buckle assembly.

In some embodiments, the buckle assembly includes a clasp and a ratchet strap. The clasp is configured to releasably couple to the buckle interface. The opposing second end of the cable is coupled to the ratchet strap. In some embodiments, the lower-leg engagement portion defines an intermediate cable interface positioned on an opposing lateral half of the lower-leg engagement portion relative to at least one of the cable end interface and the buckle interface. In some embodiments, the cable closure system further includes a cable guide coupled to the intermediate cable interface, and the cable guide is positioned to receive an intermediate portion of the cable.

In some embodiments, the cable guide includes a hook that extends from the intermediate cable interface. In some embodiments, the cable guide includes a housing and an internal bearing disposed within the housing. The internal bearing facilitates movement of the intermediate portion of the cable through the housing during a tightening operation or a loosening operation of the cable closure system. In some embodiments, the cable guide is removably coupled to the intermediate cable interface.

In some embodiments, the intermediate cable interface defines a recess that receives an intermediate portion of the cable. In some embodiments, the intermediate cable interface is a first intermediate cable interface. The lower-leg engagement portion may define a second intermediate cable interface positioned on an opposing lateral half of the lower-leg engagement portion relative to the first intermediate cable interface. In some embodiments, the protective footwear includes a core disposed within the foot engagement portion and the lower-leg engagement portion. The lower-leg engagement portion includes an exoskeleton defining a plurality of apertures. The plurality of apertures may be positioned such that at least a portion of the core is exposed to an external environment.

In some embodiments, the protective footwear includes a ventilation system. The ventilation system may include an intake vent, an exhaust vent and an airflow conduit. The intake vent is disposed within a toe portion of the foot engagement portion and positioned to receive an inlet airflow from an external environment. The exhaust vent is disposed with a heel portion of the foot engagement portion and positioned to provide an exit airflow to the external environment. The airflow conduit extends between the intake vent and the exhaust vent. The airflow conduit defines one or more slots positioned to facilitate the entry of the inlet airflow from the intake vent into an internal cavity of the foot engagement portion and facilitate the exit of the exit airflow from the internal cavity of the foot engagement portion through the exhaust vent.

In some embodiments, the footwear includes a shank disposed within a sole of the foot engagement portion. The shank includes a plate, a sidewall, and a dampening layer. The plate is positioned to extend along a bottom of a foot of the wearer. The sidewall extends from the plate and is positioned to extend at least one of around a heel and along at least one side of an ankle of the wearer. The dampening layer is disposed within the plate. In some embodiments, the footwear includes a pivotal hinge system positioned to pivotally couple the lower-leg engagement portion to the foot engagement portion. The sidewall of the shank includes a hinge support positioned to extend along the at least one side of the ankle of the wearer. The hinge support can support the pivotal hinge system.

In some embodiments, one or more rubber sections are disposed along a medial side of the lower-leg engagement portion and the foot engagement portion.

Another embodiment relates to a boot. The boot includes a foot engagement portion, a lower-leg engagement portion, and a cable closure system. The foot engagement portion defines a cable end interface. The foot engagement portion or the lower-leg engagement portion defines a buckle interface. The cable closure system includes a buckle assembly configured to releasably couple to the buckle interface and a cable extending between the cable end interface and the buckle assembly. The cable has a first end coupled to the cable end interface and an opposing second end coupled to the buckle assembly.

In some embodiments, the lower-leg engagement portion defines a second cable end interface and a second buckle interface. The boot can include a second cable closure system. The second cable closure system includes a second buckle assembly and a second cable. The second buckle assembly may releasably couple to the second buckle interface. The second cable extends between the second cable end interface and the second buckle assembly. The second cable has a first end coupled to the second cable end interface and an opposing second end coupled to the second buckle assembly.

In some embodiments, the lower-leg engagement portion defines a band interface that extends from a first portion of the lower-leg engagement portion. The lower-leg engagement portion includes a band closure system. The band closure system includes an elastic band coupled a second portion of the lower-leg engagement portion. The elastic band may releasably engage with the band interface to selectively close the first portion and the second portion of the lower-leg engagement portion together around a leg of a wearer of the boot.

Still another embodiment relates to a cable closure system for footwear. The cable closure system includes a buckle assembly, a cable, and a cable guide. The buckle assembly includes a clasp configured to releasably couple to a buckle interface of the footwear and a strap extending from the clasp. The cable has a first end configured to couple to a cable end interface of the footwear and an opposing second end coupled to the strap. The cable guide is configured to couple to a cable guide interface of the footwear and receive an intermediate portion of the cable. The cable guide is configured to be coupled to the cable guide interface on an opposing side of the footwear relative to at least one of the buckle interface and the cable end interface.

Yet another embodiment relates to a footwear. The footwear includes a foot engagement portion and a ventilation system disposed within the foot engagement portion. The foot engagement portion defines an interior cavity configured to receive a foot of a wearer. The foot engagement portion includes a toe portion and a heel portion. The ventilation system includes an inlet vent disposed within the toe portion and positioned to receive an inlet airflow from an external environment, and a conduit extending from the inlet vent along the interior cavity of the foot engagement portion. The conduit defines one or more slots positioned to facilitate the entry of the inlet airflow from the inlet vent into the interior cavity of the foot engagement portion.

The ventilation system may include an outlet vent disposed with the heel portion of the foot engagement portion and positioned to provide an exit airflow to the external environment. The conduit extends between the inlet vent and the outlet vent. The one or more slots are positioned to facilitate the exit of the exit airflow from the interior cavity of the foot engagement portion through the outlet vent.

Yet another embodiment relates to a footwear. The footwear includes a foot engagement portion, a lower-leg engagement portion, and a band closure system. The lower-leg engagement portion has a first portion and a second portion at least partially separated from the first portion. The first portion defines a band interface extending therefrom. The second portion defines a first band coupler and a second band coupler. The band closure system includes a first flexible band, a second flexible band, and a retainer. The first flexible band has a first end configured to couple to the first band coupler and an opposing second end. The second flexible band has a first end configured to couple to the second band coupler and an opposing second end. The retainer couples the opposing second end of the first flexible band to the opposing second end of the second flexible band. The retainer is configured to releasably engage with the band interface to selectively close the first portion and the second portion of the lower-leg engagement portion together around a leg of a wearer of the footwear.

Yet another embodiment relates to a footwear. The footwear includes a foot engagement portion and a shank disposed within a sole of the foot engagement portion. The shank includes a plate, a sidewall, and a dampening layer. The plate is positioned to extend along a bottom of a foot of a wearer. The sidewall extends from the plate and is positioned to extend around a heel of the wearer. An internal chamber is formed between the plate and the sidewall. The dampening layer is disposed within the internal chamber.

In some embodiments, the plate and the sidewall are manufactured from at least one of carbon fiber, carbon fiber encapsulated with thermoplastic polyurethane, fiberglass, thermoplastic polyurethane, metal, steel, aluminum, titanium, a plastic material, and a composite material. In some embodiments, the shank includes a toe portion extending from the plate and positioned to extend around toes of the wearer. In some embodiments, a portion of at least one of the plate and the sidewall is exposed through the foot engagement portion such that the portion of the at least one of the plate and the sidewall forms at least a part of an exterior of the footwear.

In some embodiments, the footwear further includes a lower-leg engagement portion and a pivotal hinge system positioned to pivotally couple the lower-leg engagement portion to the foot engagement portion. The sidewall of the shank includes a hinge support extending therefrom and positioned to extend along at least one side of an ankle of the wearer. The hinge support can support the pivotal hinge system.

A method of securing a footwear to a wearer's leg and/or foot includes providing equal pressure at one or more points on the wearer's leg. The method may include providing a cable closure system to secure the footwear about the wearer's leg and/or foot. The cable closure system may include a buckle assembly and a cable. The buckle assembly may releasably couple to the buckle interface. The cable may extend between the cable end interface and the buckle assembly, the cable having a first end coupled to the cable end interface and an opposing second end coupled to the buckle assembly.

A method of ventilating an interior of a protective footwear to remove warm and/or moist air from the interior of the footwear may include providing a ventilation system. The ventilation system may include an intake vent, an exhaust vent, and an airflow conduit extending between the intake and exhaust vents. The intake vent may be disposed within a toe portion of the foot engagement portion and positioned to receive an inlet airflow from an external environment. The exhaust vent may be disposed with a heel portion of the foot engagement portion and positioned to provide an exit airflow to the external environment. The airflow conduit may define one or more slots positioned to facilitate the entry of the inlet airflow from the intake vent into an internal cavity of the foot engagement portion and facilitate the exit of the exit airflow from the internal cavity of the foot engagement portion through the exhaust vent.

A method of providing a comfortable and flexible adjustment to a wear may include providing a band closure system. The band closure system may be flexible (e.g., include elastic, silicone, etc.). The band closure system may include a first flexible band, a second flexible band, and a retainer. The first flexible band may have a first end configured to couple to the first band coupler and an opposing second end. The second flexible band may have a first end configured to couple to the second band coupler and an opposing second end. The retainer may couple the opposing second end of the first flexible band to the opposing second end of the second flexible band. The retainer may releasably engage with the band interface to selectively close the first portion and the second portion of the lower-leg engagement portion together around a leg of a wearer of the footwear.

A method of facilitating pivotable movement between a foot engagement portion and a lower-leg engagement portion of a protective footwear may include providing a pivotal hinge system. The pivotal hinge system may be positioned to pivotally couple the lower-leg engagement portion to the foot engagement portion. The system may limit rotational movement of the lower-leg engagement portion relative to the foot engagement portion about a set range of motion.

The pivotal hinge system may include an ankle dampening system coupled with the pivotal hinge and configured to allow for additional rotational movement of the lower-leg engagement portion relative to the foot engagement portion beyond a limit of the set range of motion to desirably provide comfort to the wearer.

A method of enhancing strength and vibration dampening in footwear may include providing a unitary foot shank disposed within a sole unit of a protective footwear.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The drawings are provided to illustrate example embodiments described herein and are not intended to limit the scope of the disclosure. Throughout the drawings, reference numbers may be re-used to indicate general correspondence between referenced elements.

DETAILED DESCRIPTION

Figure 1:
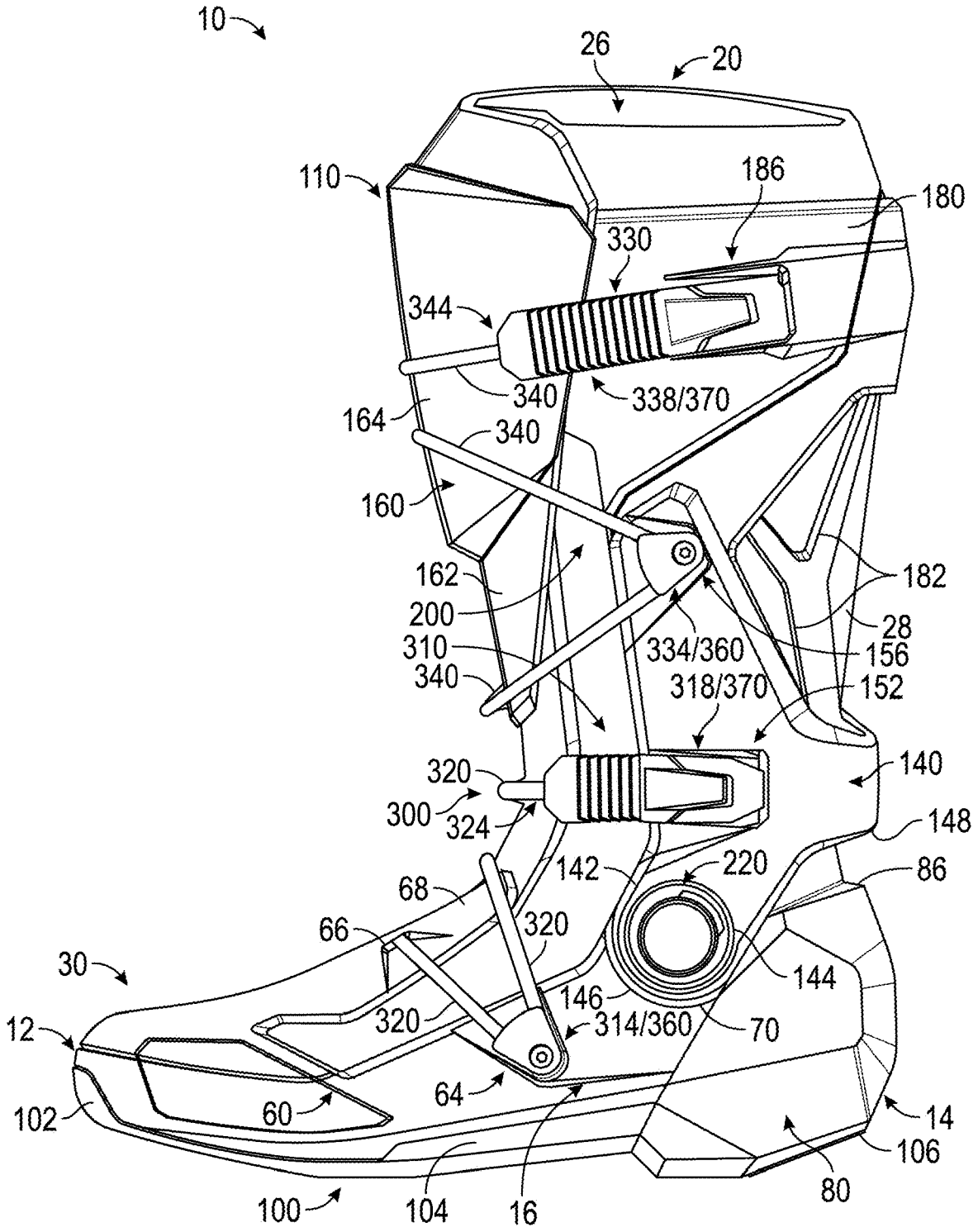
FIG. 1 is a lateral view of a protective footwear having a cable closure system, according to an example embodiment.

Various aspects of the inventive concepts will now be described with regard to certain examples and embodiments, which are intended to illustrate but not to limit the disclosure. Nothing in this disclosure is intended to imply that any particular feature or characteristic of the disclosed embodiments is essential. The scope of protection is defined by the claims that follow this description and not by any particular embodiment described herein. Before turning to the figures, which illustrate example embodiments in detail, it should be understood that the application is not limited to the details or methodology set forth in the description or illustrated in the figures. It should also be understood that the terminology is for the purpose of description only and should not be regarded as limiting.

Embodiments herein generally relate to protective footwear (e.g., boots, shoes, motocross boots, etc.). Such protective footwear may be used in a number of activities, including without limitation: sports and athletics, including extreme sports and traditional sports; military and combat activity; law enforcement; outdoor activities such as camping, hiking, and climbing; automotive and cycling activities, including auto racing, motorcycle riding and racing, motocross, Baja racing, long distance and/or endurance racing;

bicycling such as BMX, mountain biking, downhill biking, etc.; equestrian and rodeo; while operating recreational vehicles including ATVs, snowmobiles, side-by-sides, and other off-road vehicles; to name just a few. The protective footwear and methods for manufacturing the same provide various improvements not present in existing protective footwear. Further details are provided herein.

According to one example embodiment, a protective footwear (e.g., a boot, a motocross riding boot, etc.) is configured to provide enhanced maneuverability and awareness for a wearer (e.g., of a dirt bike he/she is riding, etc.). The protective footwear may include features that provide various non-limiting advantages relative to other protective footwear. By way of example, the protective footwear may include a unitary foot shank disposed within a sole unit of the protective footwear that provides enhanced strength, while increasing comfort and vibration dampening. By way of another example, the protective footwear may include a cable closure system that provides equal pressure at various points of a wearer's leg to provide a snug, secure fit. By way of yet another example, the protective footwear may include a ventilation system configured to circulate fresh air into the interior of the protective footwear and/or remove warm and/or moist air from the interior of the protective footwear. By way of still another example, the protective footwear may include a flexible (e.g., elastic, silicone, etc.) band closure system. By way of still yet another example, the protective footwear may include a core (e.g., foam lining, etc.) that has a lightweight, a stretchable, and/or a breathable material that forms at least a portion of the exterior of the protective footwear. By way of a further example, the protective footwear may include a pivotal hinge system configured to facilitate pivotal movement between a foot engagement portion and a lower-leg engagement portion of the protective footwear.

Construction of Protective Footwear

According to the example embodiments shown in FIGS. 1-46, a footwear, shown as protective footwear 10, includes a liner, shown as core 20; a first exterior portion, shown as foot engagement portion 30; a second portion, shown as lower-leg engagement portion 110; a pivotal coupler, shown as pivotal hinge system 220, a first closure system, shown as cable closure system 300; a second closure system, shown as band closure system 400; a ventilation system, shown as ventilation system 500; and/or a dampening system, shown as ankle dampening system 600. According to an example embodiment, the protective footwear 10 is a motocross boot. In other embodiments, the protective footwear 10 is a snowmobile boot, an ATV boot, a hiking boot, a motorcycle boot, a snowboarding boot, a skiing boot, and/or another type of boot used for action sports, non-action sports, and/or recreational purposes. In still other embodiments, the protective footwear 10 is another type of boot (e.g., a military boot, a construction boot, etc.). In some embodiments, the protective footwear 10 does not include the lower-leg engagement portion 110 (e.g., the protective footwear 10 is a low-top boot, a high-top shoe, a shoe, an athletic shoe, etc.).

Figure 18:
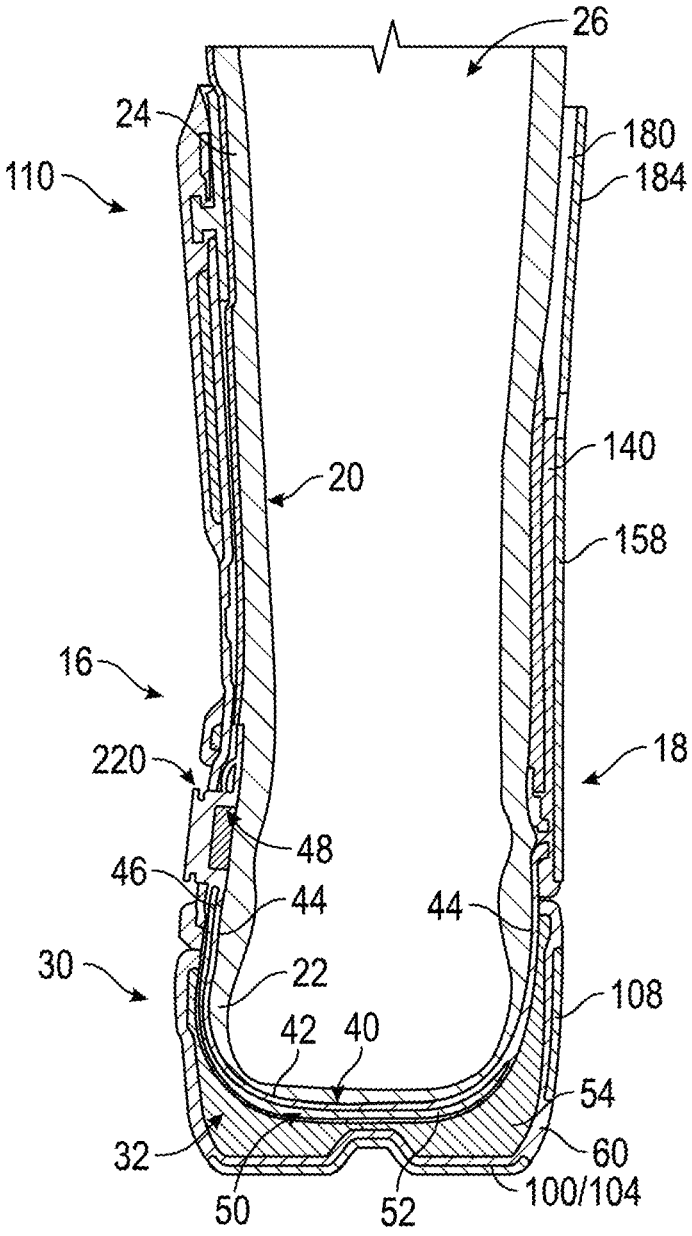
Figure 19:
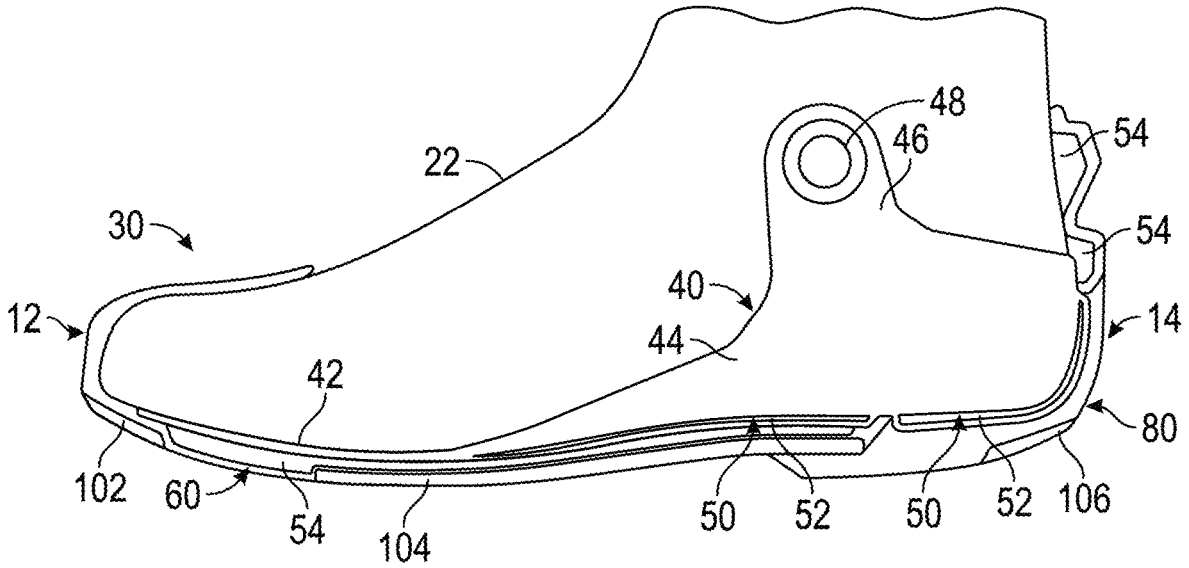
FIG. 19 is detailed cross-sectional view of a foot shank of the protective footwear of FIG. 1, according to an example embodiment.
Figure 20:
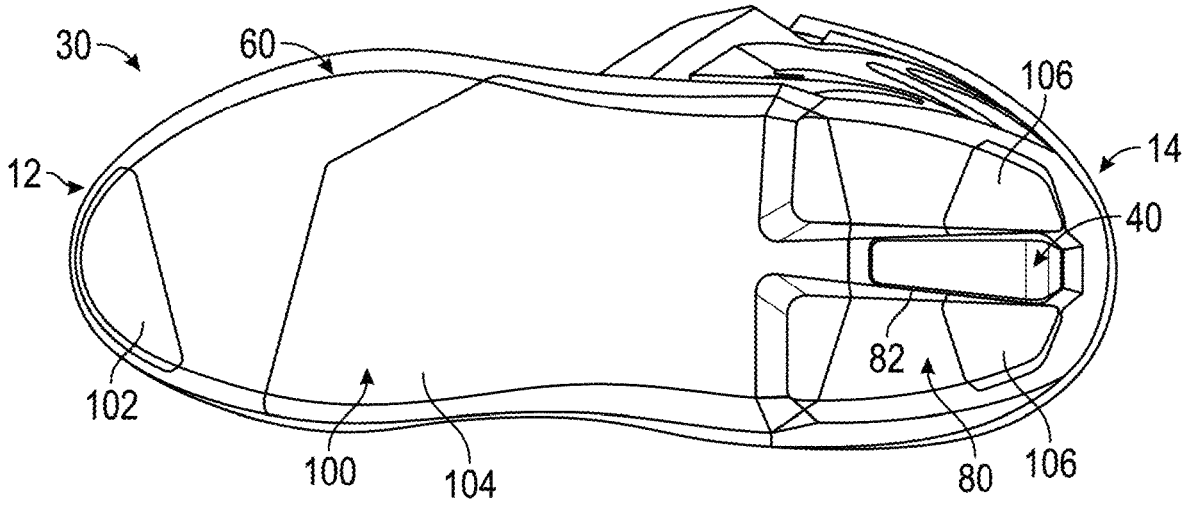
FIG. 20 is a bottom view of the protective footwear of FIG. 1, according to an example embodiment.
Figure 21:
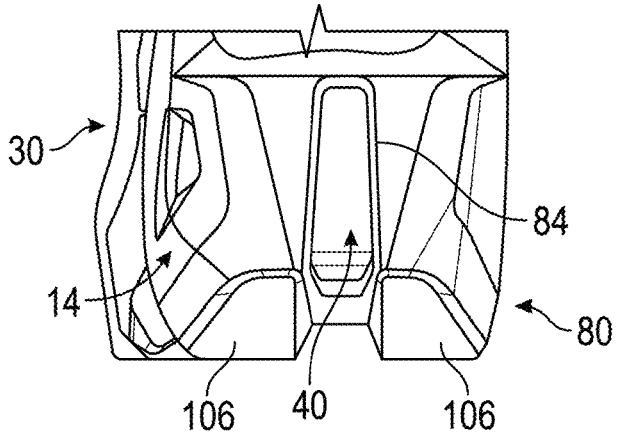
FIG. 21 is a rear view of a heel portion of the protective footwear of FIG. 1, according to an example embodiment.
Figure 24:
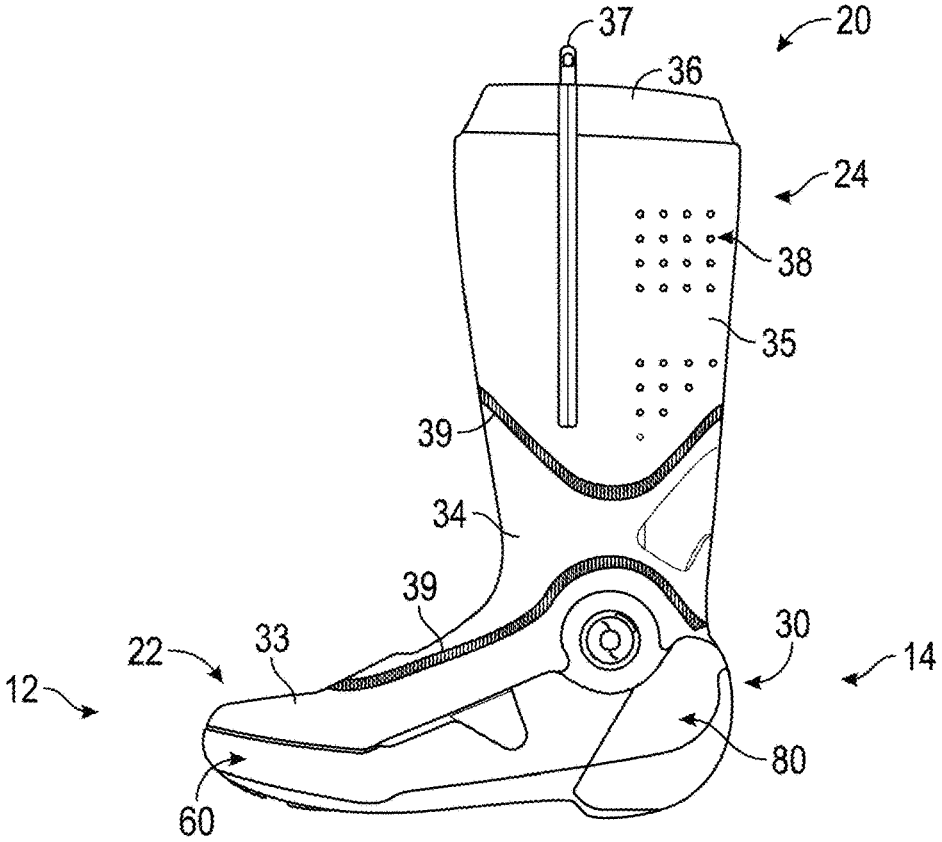
FIGS. 24 and 25 are various views of the construction of the protective footwear of FIG. 22, according to an example embodiment.
Figure 25:
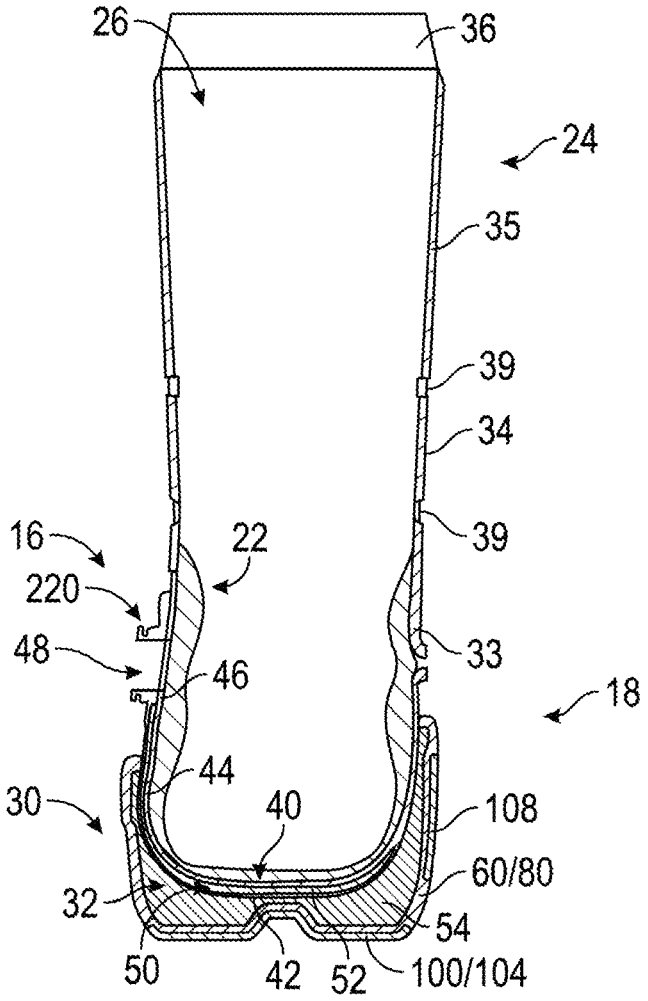

As shown in FIGS. 1, 2, 18-28, and 36-40, the protective footwear 10 has a front end, shown as toe end 12; an opposing rear end, shown as heel end 14; a first side, shown as lateral side 16; and an opposing second side, shown as medial side 18. As shown in FIGS. 10-15, 18, 24, and 25, the core 20 has a first portion, shown as foot portion 22, and a second portion, shown as leg portion 24. As shown in FIGS. 18 and 25, the foot engagement portion 30 defines an internal cavity, shown as interior cavity 32, configured to receive the foot portion 22 of the core 20. As shown in FIG. 18, the lower-leg engagement portion 110 defines an internal cavity, shown as interior cavity 112, configured to receive the leg portion 24 of the core 20. As shown in FIGS. 1, 2, 10-16, 18, 25, and 36-40, the core 20 defines an internal cavity, shown as interior cavity 26, configured to receive a foot and/or a leg of a wearer of the protective footwear 10. In some embodiments, the core 20 does not include the leg portion 24 (e.g., in embodiments where the protective footwear 10 does not include the lower-leg engagement portion 110; in embodiments where the protective footwear 10 is a shoe, a low-top boot, etc.).

According to an example embodiment, at least a portion of the core 20 is manufactured from a foam material (e.g., Polyurethane ("PU") foam, etc.) or another conformable, impact attenuating material. The foam material may be configured to conform to the shape of the foot and/or the leg of the wearer of the protective footwear 10 to provide an enhanced fit, enhanced comfort, and/or impact force attenuation (e.g., from flying debris, dirt, mud, etc.). According to the example embodiment shown in FIGS. 1, 2, and 10-16, at least a portion, shown as portion 28, of the core 20 is manufactured from a lightweight, a stretchable, and/or a breathable material (e.g., a flyknit material, lightweight yarn, thermoplastic polyurethane ("TPU") yarn, etc.). In other embodiments, the portion 28 of the core 20 is manufactured from the same material as the rest of the core 20. In still other embodiments, the portion 28 of the core 20 is manufactured from carbon fiber fabric, Kevlar fabric, nylon fabric, a mesh material, an at least partially permeable material, and/or still another material.

In some embodiments, the core 20 has a different structure. As shown in FIGS. 24 and 25, the foot portion 22 of the core 20 includes a first material, shown as foot material 33, and the leg portion 24 of the core 20 includes a second material, shown as ankle material 34, and a third material, shown as shin/calf material 35. The foot material 33 may be or include synthetic leather, leather, neoprene, nylon polyester, woven polyester, microfiber, polyvinyl chloride ("PVC"), and/or still another material. The ankle material 34 may be or include neoprene, nylon, woven polyester, knit polyester, and/or still another material. The shin/calf material 35 may be or includes neoprene, nylon, woven polyester, knit polyester, and/or still another material. As shown in FIGS. 24 and 25, the foot material 33, the ankle material 34, and the shin/calf material 35 are secured together by stitching, shown as stitching 39. The core 20 further includes a band, shown as elastic band 36, coupled to the top of the leg portion 24 of the core 20. According to an example embodiment, the elastic band 36 is manufactured from an elastomeric material such that the elastic band 36 forms to the shape and size of a wearer's leg to prevent dirt, mud, debris, water, etc. from entering the interior cavity 26 of the core 20. By way of example, the elastic band 36 may be manufactured from neoprene, knit polyester, silicone, rubber, and/or still another material. As shown in FIG. 24, the shin/calf material 35 defines a plurality of apertures, shown as perforations 38. According to an example embodiment, the perforations 38 provide ventilation and breathability for the core 20.

Figure 41:
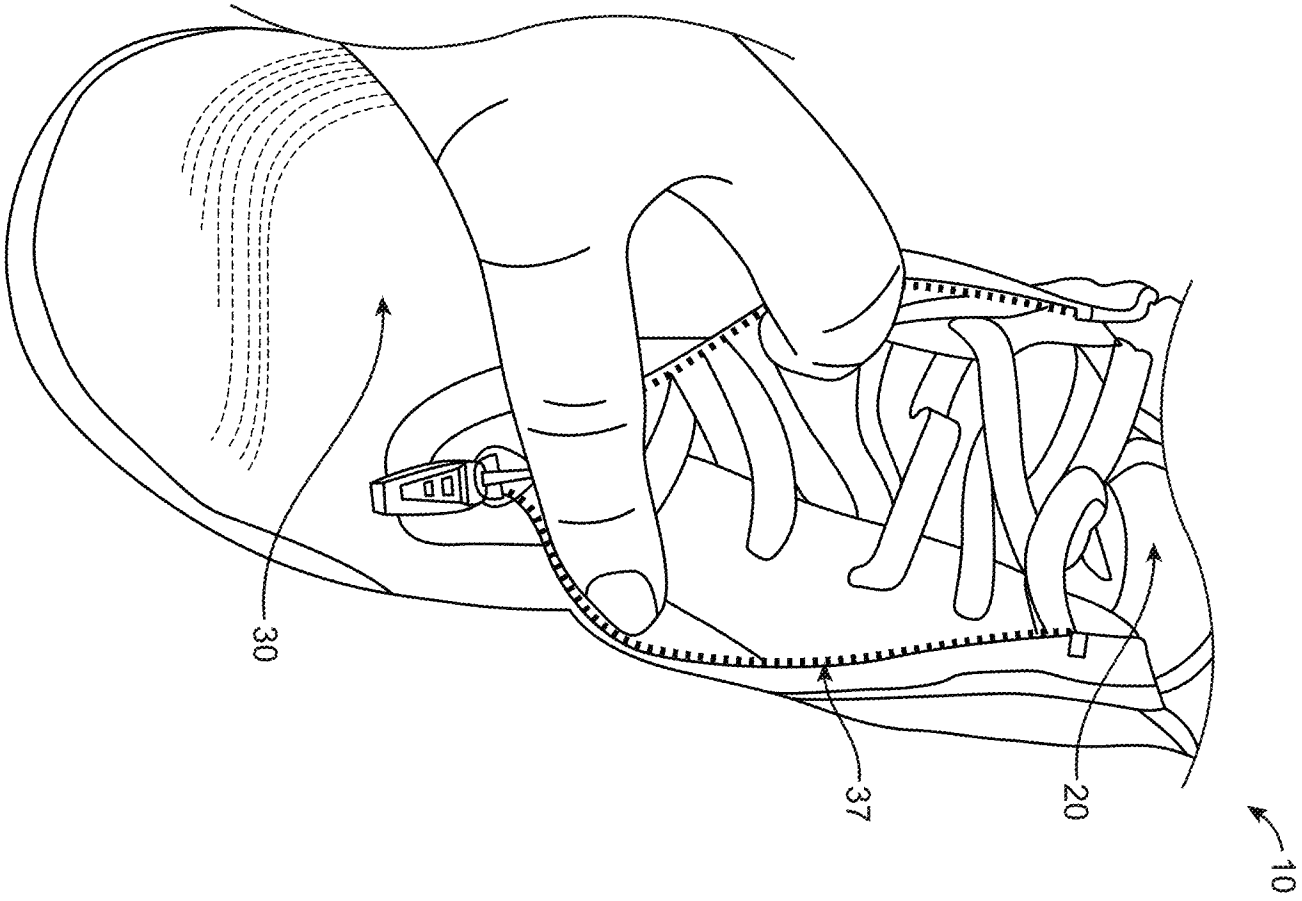
FIG. 41 is a detail view of a closure element of the protective footwear of FIG. 36, according to an example embodiment.
Figure 42:
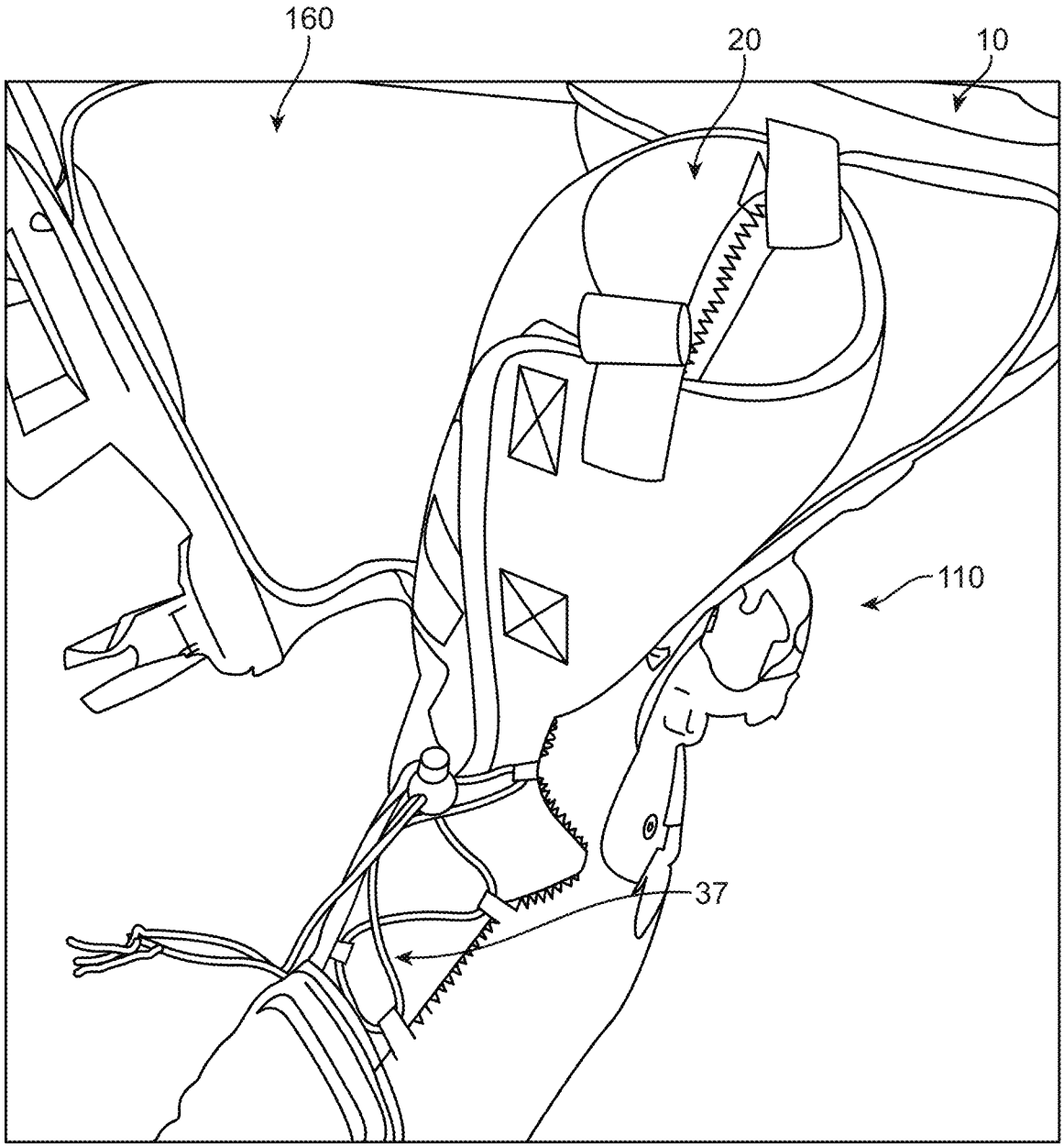
FIG. 42 is a front perspective view of the construction of the protective footwear of FIG. 36, according to an example embodiment.

The core 20 may include a closure element 37 (e.g., a zipper, a lacing system, etc.) that is configured to facilitate loosening and tightening the core 20 around a wearer's leg to allow for easy insertion and removal of a foot into and from the core 20, as well as provide a secure fit. The core 20 described in other examples, such as in the footwear 10 described consistent with implementations of the current subject matter may also include the closure element 37. FIG. 24 shows an example of a zipper 37 that extends perpendicular from the upper surface of the core 20. FIG. 41 shows another example of the zipper 37 that extends on an angle relative to the upper surface of the core 20. The zipper 37 may extend across at least a portion of the lower-leg engagement portion 110 and/or the foot engagement portion 30 of the footwear 10. In some embodiments, the zipper 37 extends along an outer membrane that wraps around and/or encloses at least a portion of the core 20 to tighten the outer membrane around the core 20 when worn. As shown in FIG. 42, the closure element 37 can include a lacing system, such as a quick-draw lacing system. The lacing system 37 can be tightened to tighten the core 20 when worn. The lacing system 37 may be implemented to facilitate fast loosening and tightening of the core 20 around the wearer's leg, as mentioned above.

Consistent with implementations of the current subject matter, the core 20 may include a support structure that attaches at the ankle region of the footwear 10 (see, e.g., FIG. 41). The support structure may be defined at least in part by the shin guard 160 and/or the calf guard 180, as described herein. The core 20 may be coupled with the support structure, or other components of the footwear 10, by stitching, for example, such that the stretchable material of the core 20 is stitched to the non-stretch material of the support structure or other components of the footwear 10 (e.g., components that include plastic or other non-stretch material).

As shown in FIGS. 1, 2, 10-16, 18-28, and 36-40, the foot engagement portion 30 includes an insole or shank, shown as foot shank 40; a first exterior portion or toe cap, shown as mud guard 60; a second exterior portion, shown as heel cap 80, and various rubber portions, shown as rubber sections 100. According to an example embodiment, portions of the foot shank 40, the mud guard 60, the heel cap 80, and/or the rubber sections 100 form a sole or sole unit of the protective footwear 10.

As shown in FIGS. 10, 11, 18, 19, 25, and 26, the foot shank 40 is disposed along the foot portion 22 of the core 20. As shown in FIGS. 1, 2, 11-16, 18, 19, 24, 26, and 36-40, the mud guard 60 is disposed around the foot portion 22 of the core 20 and a first portion (e.g., a front portion, a toe portion, etc.) of the foot shank 40 is positioned near the toe end 12 of the foot engagement portion 30 of the protective footwear 10. The heel cap 80 is disposed around the foot portion 22 of the core 20 and a second portion (e.g., a rear portion, a heel portion, etc.) of the foot shank 40 is positioned near the heel end 14 of the foot engagement portion 30 of the protective footwear 10. The foot shank 40 may thereby be enclosed within the sole unit of the foot engagement portion 30 between the foot portion 22 of the core 20, the mud guard 60, and the heel cap 80.

As shown in FIGS. 18, 19, 25, and 26, the foot shank 40 includes a plate or insole board, shown as foot plate 42, positioned to extend from the heel end 14 to the toe end 12 of the foot engagement portion 30 along a bottom of the foot portion 22 of the core 20. The foot plate 42 may thereby be positioned to correspond with and provide support to a bottom of a foot of the wearer of the protective footwear 10. In some embodiments, the foot plate 42 extends along an entire length of the bottom of the foot portion 22 of the core 20. In other embodiments, the foot plate 42 extends along a portion of the length between the heel end 14 and the toe end 12 of the foot engagement portion 30.

As shown in FIGS. 18, 19, 25, and 26, the foot shank 40 includes an extension, shown as hinge support 46, extending from the heel support 44 and positioned to extend along at least one side of an ankle of the wearer. In one embodiment, the hinge support 46 extends along the lateral side 16 and the medial side 18 of the foot portion 22 of the core 20. In other embodiments, the hinge support 46 extends along the lateral side 16 or the medial side 18 of the foot portion 22 of the core 20 (e.g., only the lateral side 16, only the medial side 18, etc.). According to an example embodiment, the hinge support 46 is configured to support the pivotal hinge system 220. As shown in FIGS. 18, 19, 25 and 26, the hinge support 46 defines an interface, shown as hinge interface 48. According to the example embodiment shown in FIGS. 18, 19, 25, and 26, the hinge interface 48 defines an aperture configured (e.g., positioned, sized, shaped, etc.) to receive at least a portion of the pivotal hinge system 220. According to the example embodiment shown in FIGS. 18 and 25, the hinge interface 48 and the pivotal hinge system 220 have an unitary structure such that at least a portion of the pivotal hinge system 220 is formed within the foot shank 40 and extends from the hinge support 46. As shown in FIGS. 18 and 25, the interior side of the pivotal hinge system 220 is hollow and/or concave such that the pivotal hinge system 220 is shaped to create room for and/or receive an ankle bone of a wearer of the protective footwear 10.

Figure 26:
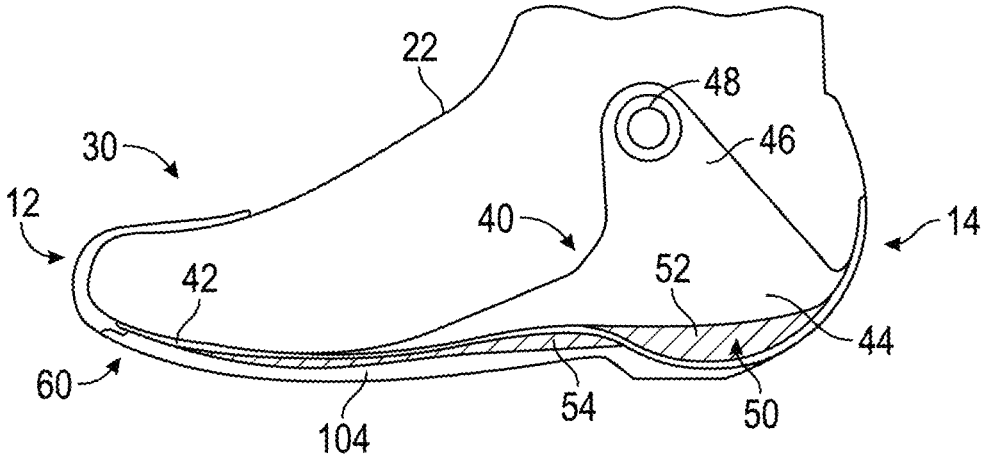
FIG. 26 is detailed cross-sectional view of a foot shank of the protective footwear of FIG. 22, according to an example embodiment.

As shown in FIGS. 18, 19, 25, and 26, the foot plate 42, the heel support 44, and/or the hinge support 46 define one or more interior cavities, shown as internal chambers 50. As shown in FIG. 26, the internal chamber 50 is defined between the heel support 44 and the foot plate 42. The internal chambers 50 are configured to receive a first dampening layer of the sole unit of the foot engagement portion 30, shown as dampening layer 52. The dampening layer 52 may be poured, cast, and/or injection molded into the internal chambers 50. According to an example embodiment, the dampening layer 52 includes a spacer foam material. The dampening layer 52 may be manufactured from PU, TPU, thermoplastic elastomers ("TPE"), ethylene-vinyl acetate ("EVA"), silicone, and/or still other suitable materials. In some embodiments, the dampening layer 52 has a honeycomb structure and/or another structure (e.g., a space frame structure, a grid structure, etc.). In some embodiments, the foot shank 40 does not define the internal chambers 50 and/or include the dampening layer 52. As shown in FIGS. 18, 19, 25, and 15, the sole unit of the foot engagement portion 30 includes a second dampening layer, shown as dampening layer 54, disposed between the foot shank 40 and the mud guard 60 and/or the heel cap 80. In one embodiment, the dampening layer 54 includes a different material than the dampening layer 52. In other embodiments, the dampening layer 52 and the dampening layer 54 include the same material. The dampening layer 54 may be manufactured from PU, TPU, TPE, EVA, silicone, and/or still other suitable materials. According to an example embodiment, the dampening layer 52 and/or the dampening layer 54 are positioned to provide impact absorption, impact force attenuation capabilities, vibration dampening, increased flexibility, and/or increased comfort to the bottom and/or sides of foot engagement portion 30.

According to an example embodiment, the foot plate 42, the heel support 44, the toe support, and/or the hinge support(s) 46 form a unitary structure (e.g., the foot shank 40 has a single, continuous structure; the foot shank 40 has a monopiece construction; etc.). The foot shank 40 may be co-molded, over molded, and/or manufactured from a fiber weave (e.g., from carbon fiber, etc.). According to an example embodiment, the foot plate 42, the heel support 44, the toe support, and the hinge support(s) 46 of the foot shank 40 are manufactured from carbon fiber and then encapsulated with TPU (e.g., to enhance the weave of the carbon fiber, to further reduce forces from external impacts, etc.). In other embodiments, the foot plate 42, the heel support 44, the toe support, and/or the hinge support(s) 46 of the foot shank 40 are manufactured from at least one of carbon fiber, carbon fiber encapsulated with TPU, carbon infused injection plastic, fiberglass, thermoplastic polyurethane, metal, steel, aluminum, titanium, a plastic material, and a composite material (e.g., a ceramic, etc.).

As shown in FIGS. 1, 2, 11-16, 18-20, 24, 26, 27, and 36-40, the mud guard 60 is disposed over the toe end 12 of the foot engagement portion 30 of the protective footwear 10 to enclose at least a portion of the foot plate 42 and/or the toe support of the foot shank 40 between the foot portion 22 of the core 20 and the mud guard 60. According to an example embodiment, the mud guard 60 is manufactured from TPU. In other embodiments, the mud guard 60 is manufactured from another suitable material such as acrylonitrile butadiene styrene ("ABS"), polyethylene ("PE"), nylon, and/or TPE.

Figure 2:
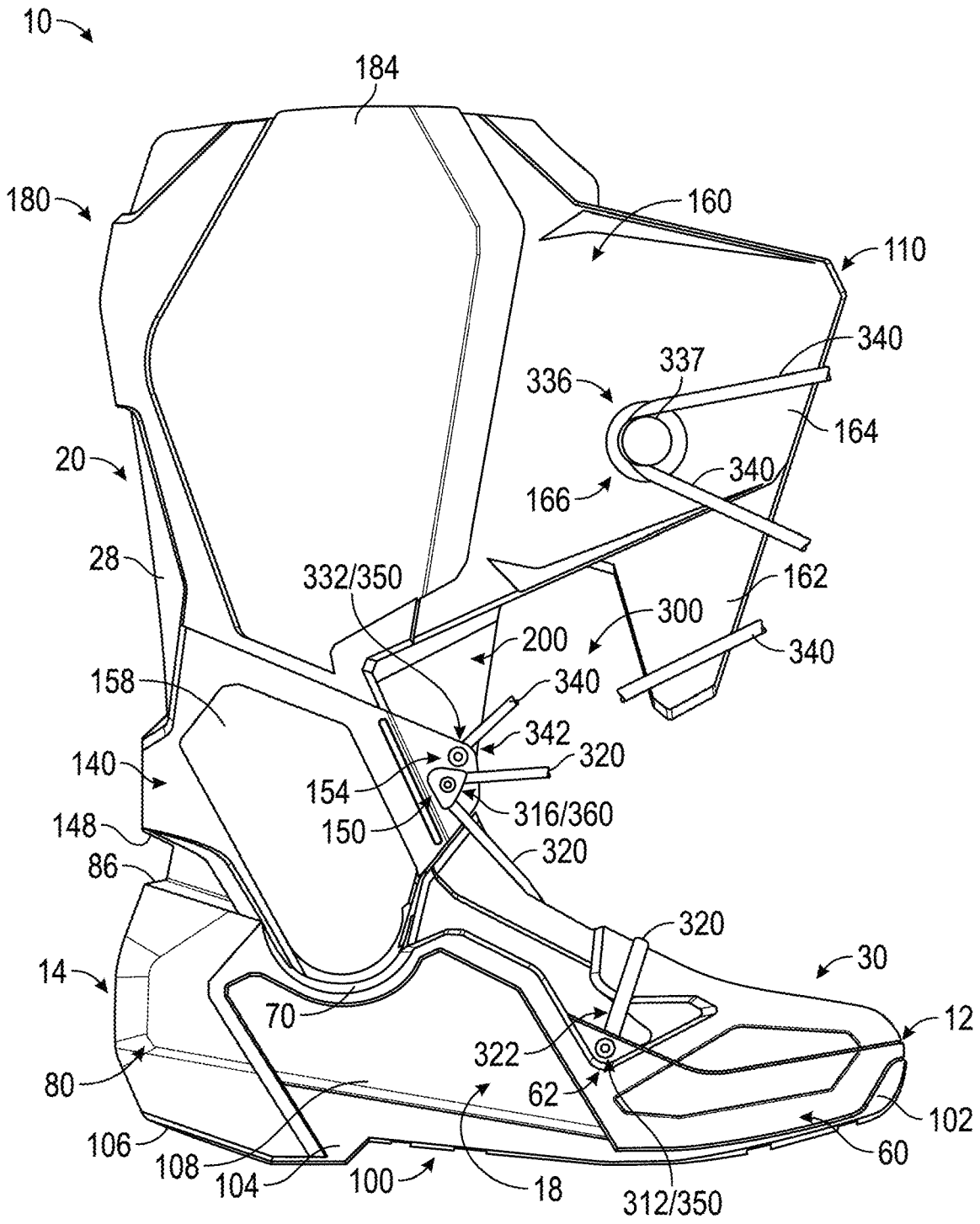
FIG. 2 is a medial view of the protective footwear of FIG. 1, according to an example embodiment.

As shown in FIG. 2, the mud guard 60 defines a first interface, shown as first cable end interface 62. According to the example embodiment shown in FIG. 2, the first cable end interface 62 is positioned on the medial side 18 of the protective footwear 10. In other embodiments, the first cable end interface 62 is positioned on the lateral side 16 of the protective footwear 10. As shown in FIG. 1, the mud guard 60 defines a second interface, shown as first intermediate cable interface 64. According to an example embodiment, the first intermediate cable interface 64 is positioned on an opposing lateral half of the protective footwear 10 relative to the first cable end interface 62. According to the example embodiment shown in FIG. 1, the first intermediate cable interface 64 is positioned on the lateral side 16 of the protective footwear 10. In other embodiments, the first intermediate cable interface 64 is positioned on the medial side 18 of the protective footwear 10. As shown in FIG. 1, the mud guard 60 defines a guide, shown as cable pass through 66, and an extension, shown as cable glide 68, the extends along the top of the foot engagement portion 30 towards the lower-leg engagement portion 110. The cable pass through 66 may be positioned to receive a portion of a cable of the cable closure system 300 and the cable glide 68 may provide a low friction surface for a portion of the cable to slide over. As shown in FIGS. 1 and 2, the mud guard 60 defines a grooved edge, shown as pivot edge 70.

As shown in FIGS. 1, 2, 12-16, 18-24, 27, 28, and 36-40 the heel cap 80 is disposed over the heel end 14 of the foot engagement portion 30 of the protective footwear 10 to enclose at least a portion of the foot plate 42 and the heel support 44 of the foot shank 40 between the foot portion 22 of the core 20 and the heel cap 80. According to an example embodiment, the heel cap 80 is manufactured from TPU. In other embodiments, the heel cap 80 is manufactured from another suitable material such as ABS, PE, nylon, and/or TPE.

As shown in FIGS. 12-16, 20, 21, 27, and 28, the heel cap 80 defines a plurality of apertures, shown as bottom aperture 82, rear aperture 84, and side aperture 86. The side aperture 86 may be defined by the lateral side 16 and/or the medial side 18 of the heel cap 80. According to the example embodiment shown in FIGS. 12-16, 20, 21, 27, and 28, at least a portion of the foot plate 42 and the heel support 44 of the foot shank 40 is exposed through the bottom aperture 82, the rear aperture 84, and the side aperture(s) 86 of the heel cap 80. The foot plate 42 and/or the heel support 44 of the foot shank 40 may thereby form at least a part of an exterior of the protective footwear 10. In some embodiments, the heel cap 80 does not define at least one of the bottom aperture 82, the rear aperture 84, and the side aperture(s) 86. In other embodiments, the heel cap 80 does not define the bottom aperture 82, the rear aperture 84, and the side aperture(s) 86 such that the foot shank 40 is entirely enclosed between the core 20, the mud guard 60, and the heel cap 80 (e.g., the foot shank 40 is not exposed, etc.). As shown in FIGS. 1 and 2, the heel cap 80 defines a stop, shown as lower pivot stop 88.

Figure 27:
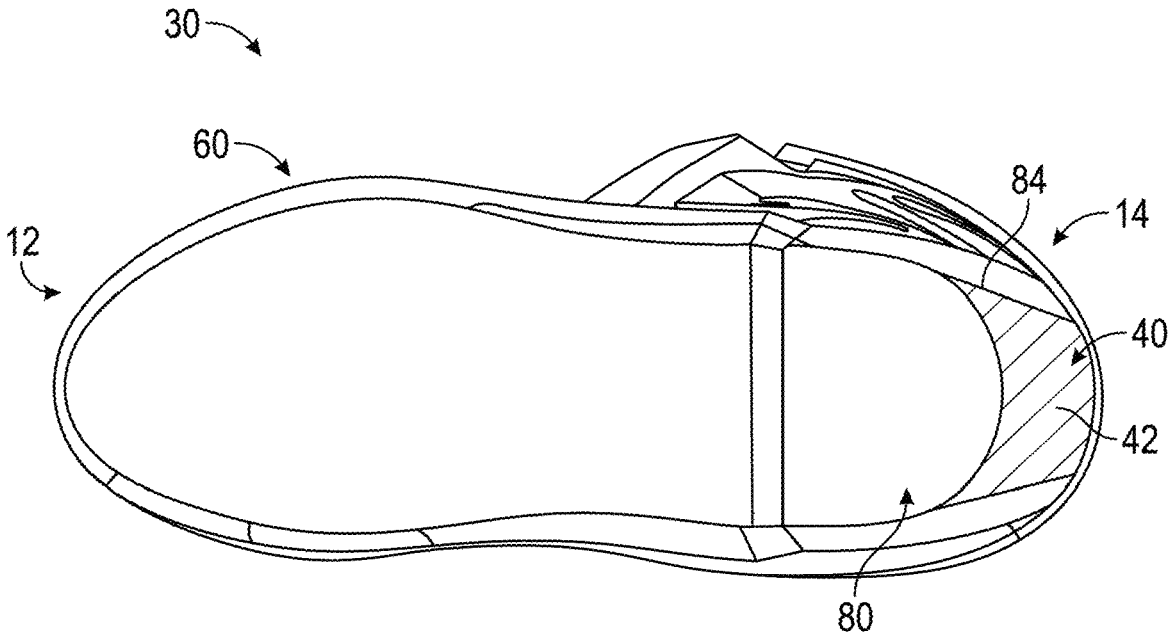
FIG. 27 is a bottom view of the protective footwear of FIG. 22, according to an example embodiment.
Figure 28:
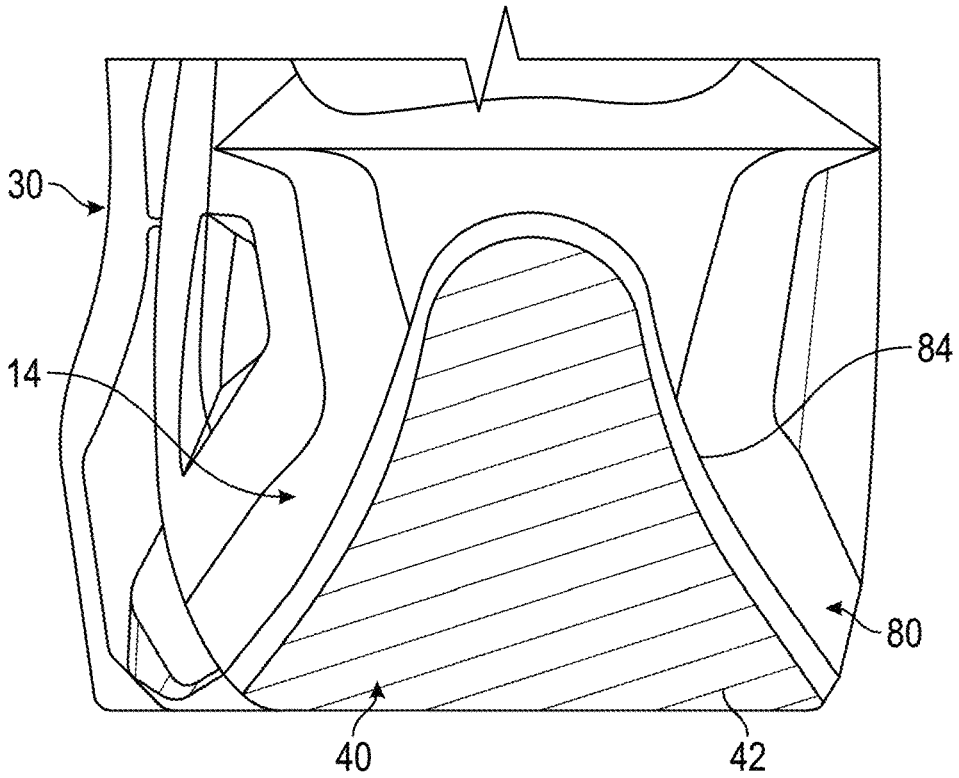
FIG. 28 is a rear view of a heel portion of the protective footwear of FIG. 22, according to an example embodiment.

As shown in FIGS. 22-24, 26-28, and 36-40, the heel cap 80 and/or the foot shank 40 cooperatively form a rounded heel structure of the foot engagement portion 30 of the protective footwear 10. According to an example embodiment, the rounded heel structure of the foot engagement portion 30 reduces friction when a wearer may drag his or her foot along the ground, reduces the amount of material needed to manufacture the protective footwear 10, and reduces the weight of the protective footwear 10. As shown in FIGS. 26-28, the foot plate 42 of the foot shank 40 is at least partially exposed through the rear aperture 84 of the heel cap 80 such that the exposed portion of the foot plate 42 forms at least a portion of the rounded heel structure.

As shown in FIGS. 1, 2, 7, 8, 11-16, 22, 23, 29-31, and 36-40, the lower-leg engagement portion 110 includes a exoskeleton, shown as calf cage 120; a third exterior portion or side guard, shown as cuff 140; a fourth exterior portion, shown as shin guard 160; a fifth exterior portion, shown as calf guard 180; and a sixth exterior portion, shown as shin cap 200.

As shown in FIGS. 11-14, the calf cage 120 is disposed along a rear portion, the lateral side 16, and the medial side 18 of the lower-leg engagement portion 110 (e.g., to correspond in location to a calf region of a wearer of the protective footwear 10, etc.). According to an example embodiment, the calf cage 120 is manufactured from durable, rigid material. By way of example, the calf cage 120 may be manufactured from ABS, PE, nylon, TPE, metal (e.g., aluminum, titanium, etc.), carbon fiber, and/or still other materials. As shown in FIGS. 11-14, the calf cage 120 defines a plurality of apertures, shown as calf apertures 122. According to an example embodiment, the calf apertures 122 are positioned such that the portion 28 of the core 20 is exposed to an external environment (e.g., the portion 28 forms at least a portion of the exterior of the protective footwear 10, etc.).

Figure 17:
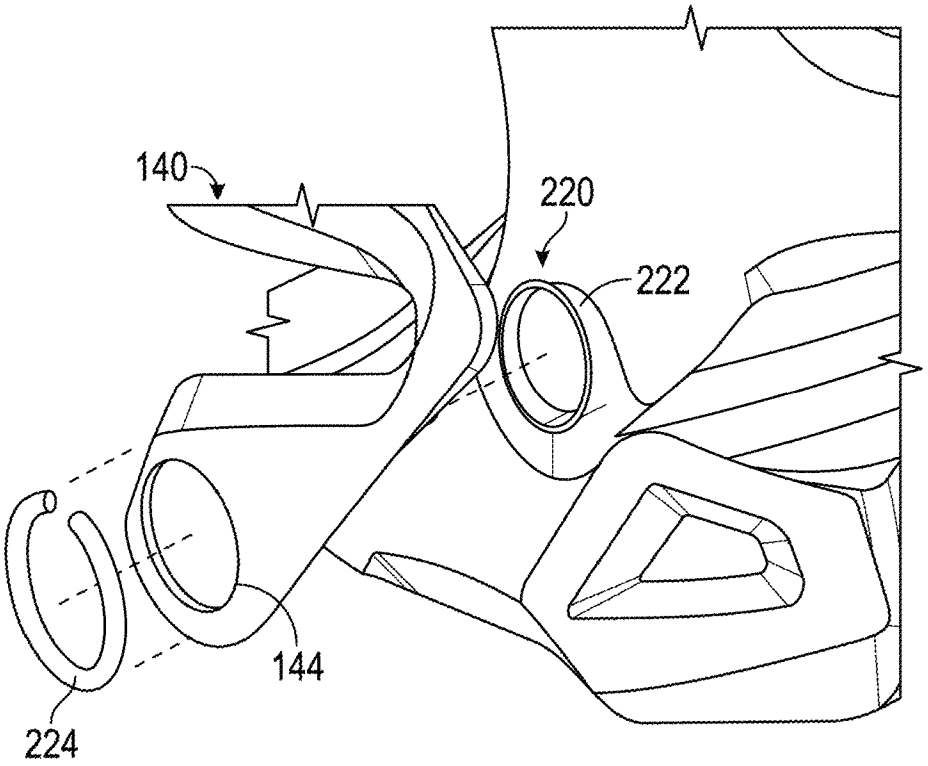
Figure 16:
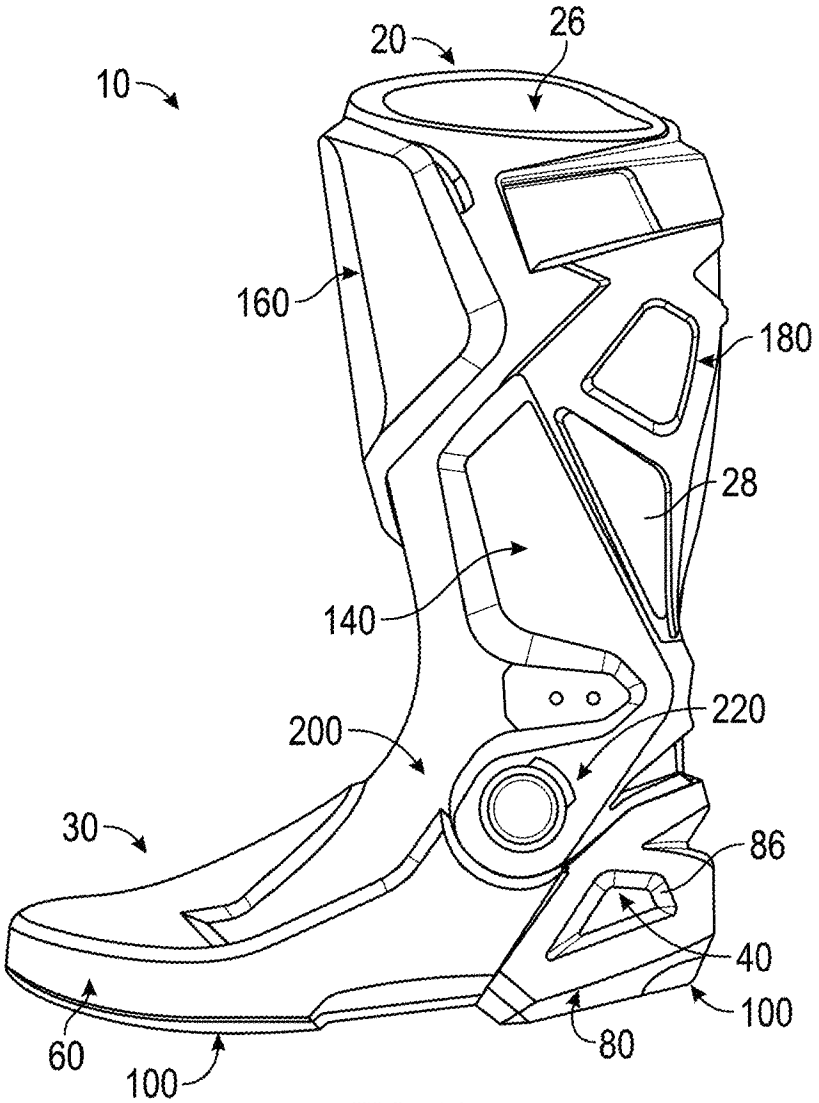

As shown in FIGS. 1, 2, 13-17, and 36-40, the cuff 140 is disposed along the lateral side 16 and the medial side 18 of the lower-leg engagement portion 110. According to an example embodiment, the cuff 140 is manufactured from TPU. In other embodiments, the cuff 140 is manufactured from another suitable material such as ABS, PE, nylon, and/or TPE. As shown in FIGS. 1 and 17, the cuff 140 includes an extension, shown as hinge extension 142, positioned on the lateral side 16 of the protective footwear 10 that defines an interface, shown as hinge interface 144. According to an example embodiment, the hinge interface 144 of the cuff 140 is positioned to align with the hinge interface 48 of the foot shank 40. According to an example embodiment, the hinge interface 144 defines an aperture that aligns with the hinge interface 48 of the foot shank 40. As shown in FIG. 17, the hinge interface 144 of the cuff 140 is positioned to receive an extension, shown as hinge pivot 222, of the pivotal hinge system 220. As shown in FIG. 17, the pivotal hinge system 220 includes a coupler, shown as clip 224 (e.g., a c-clip, etc.), that is configured to interface with the hinge interface 144 and be received by the hinge pivot 222 (e.g., a recess defined around the hinge pivot 222, etc.) to pivotally secure the lower-leg engagement portion 110 to the foot engagement portion 30. In some embodiment, the cuff 140 is detachably coupled (e.g., fastened, snap fit, with screws, etc.) to the protective footwear 10 such that the cuff 140 may be removed, changed, etc. for serviceability.

According to an example embodiment, the pivotal hinge system 220 is configured to pivotally couple the lower-leg engagement portion 110 to the foot engagement portion 30 such that the lower-leg engagement portion 110 pivots relative to the foot engagement portion 30. As shown in FIG. 1, the hinge extension 142 defines a curved edge, shown as pivot edge 146, positioned to abut and mate with the pivot edge 70 of the mud guard 60. The curved profiles of the pivot edge 70 and the pivot edge 146 facilitate the rotation of the lower-leg engagement portion 110 relative to the foot engagement portion 30. As shown in FIGS. 1 and 2, the cuff 140 includes a stop, shown as upper pivot stop 148, that extends between the lateral side 16 and the medial side 18 of the cuff 140. According to an example embodiment, the upper pivot stop 148 of the cuff 140 is positioned to engage with the lower pivot stop 88 of the heel cap 80 to limit a rotational range of motion of the lower-leg engagement portion 110 relative to the foot engagement portion 30 to within an anatomically acceptable rotational range of motion. According to the example embodiment shown in FIGS. 1 and 2, the hinge interface 144, the hinge interface 48, and the pivotal hinge system 220 are positioned on the lateral side 16 of the protective footwear 10 (e.g., a single hinge arrangement, etc.). In other embodiments, the hinge interface 144, the hinge interface 48, and the pivotal hinge system 220 are additionally or alternatively positioned on the medial side 18 of the protective footwear 10 (e.g., a single hinge arrangement, a dual hinge arrangement, etc.). In an alternative embodiment, the protective footwear 10 does not include the pivotal hinge system 220.

As shown in FIG. 2, the cuff 140 defines a third interface, shown as second intermediate cable interface 150. In an alternative embodiment, the mud guard 60 defines the second intermediate cable interface 150. In another alternative embodiment, the cuff 140 does not define the second intermediate cable interface 150. According to an example embodiment, the second intermediate cable interface 150 is positioned on an opposing lateral half of the protective footwear 10 relative the first intermediate cable interface 64. According to the example embodiment shown in FIG. 2, the second intermediate cable interface 150 is positioned on the medial side 18 of the protective footwear 10. In other embodiments, the second intermediate cable interface 150 is positioned on the lateral side 16 of the protective footwear 10.

As shown in FIG. 1, the cuff 140 defines a fourth interface, shown as first buckle interface 152. In an alternative embodiment, the mud guard 60 defines the first buckle interface 152. In another alternative embodiment, the first buckle interface 152 replaces the second intermediate cable interface 150. In yet another alternative embodiment, the cuff 140 does not define the first buckle interface 152. According to an example embodiment, the first buckle interface 152 is positioned on an opposing lateral half of the protective footwear 10 relative the second intermediate cable interface 150 and the first cable end interface 62. According to the example embodiment shown in FIG. 1, the first buckle interface 152 is positioned on the lateral side 16 of the protective footwear 10. In other embodiments, the first buckle interface 152 is positioned on the medial side 18 of the protective footwear 10.

As shown in FIG. 2, the cuff 140 defines a fifth interface, shown as second cable end interface 154. According to the example embodiment shown in FIG. 2, the second cable end interface 154 is positioned on the medial side 18 of the protective footwear 10. In other embodiments, the second cable end interface 154 is positioned on the lateral side 16 of the protective footwear 10. As shown in FIG. 1, the cuff 140 defines a sixth interface, shown as third intermediate cable interface 156. According to an example embodiment, the third intermediate cable interface 156 is positioned on an opposing lateral half of the protective footwear 10 relative to the second cable end interface 154. According to the example embodiment shown in FIG. 1, the third intermediate cable interface 156 is positioned on the lateral side 16 of the protective footwear 10. In other embodiments, the third intermediate cable interface 156 is positioned on the medial side 18 of the protective footwear 10.

As shown in FIGS. 1, 2, 14-16, and 42, the shin guard 160 is disposed along a front portion of the lower-leg engagement portion 110 (e.g., to correspond in location to a shin region of a wearer of the protective footwear 10, etc.). As shown in FIGS. 1 and 2, the shin guard 160 includes a first layer, shown as under layer 162, and a second layer, shown as over layer 164, overlying at least a portion of the under layer 162. A portion of the under layer 162 may thereby be exposed to an external environment. According to an example embodiment, the under layer 162 has a greater rigidity, strength, and/or density than the over layer 164. The combination of the under layer 162 and the over layer 164 may thereby provide increased protection to a shin region of a leg of a wearer of the protective footwear 10 (e.g., from flying debris, etc.). According to the example embodiment, the under layer 162 is manufactured from carbon fiber and the over layer 164 is manufactured from TPU. In other embodiments, at least one of the under layer 162 and the over layer 164 of the shin guard 160 are manufactured from another suitable material. By way of example, the under layer 162 and/or the over layer 164 may be manufactured from carbon fiber, TPU, TPE, nylon, and/or still another material. As shown in FIGS. 1 and 2, the shin guard 160 is selectively repositionable between an open position and a closed position to facilitate a wearer with inserting his or her leg into the interior cavity 26 of the core 20 of the protective footwear 10.

As shown in FIG. 2, the shin guard 160 defines a seventh interface, shown as fourth intermediate cable interface 166. In alternative embodiment, the shin guard 160 does not define the fourth intermediate cable interface 166. According to an example embodiment, the fourth intermediate cable interface 166 is positioned on an opposing lateral half of the protective footwear 10 relative the third intermediate cable interface 156. According to the example embodiment shown in FIG. 2, the fourth intermediate cable interface 166 is positioned towards the medial side 18 of the protective footwear 10. In other embodiments, the fourth intermediate cable interface 166 is positioned on the lateral side 16 of the protective footwear 10.

Figure 15:
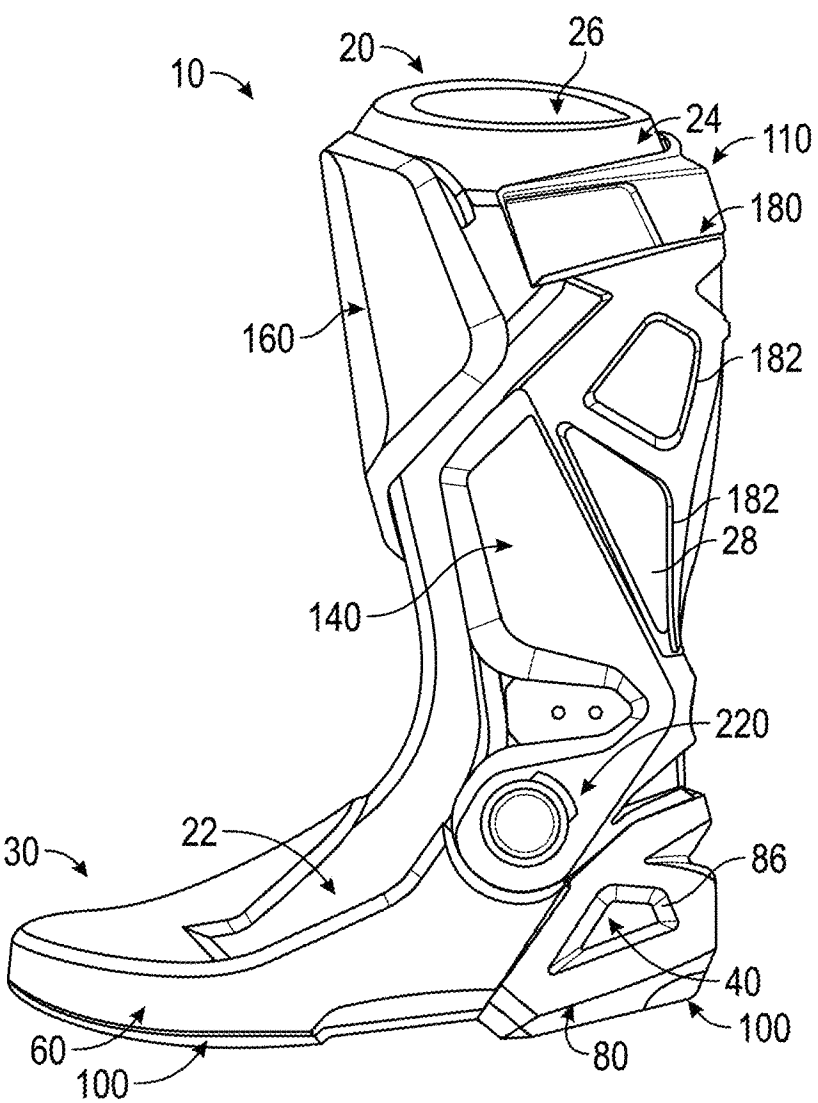
Figure 14:
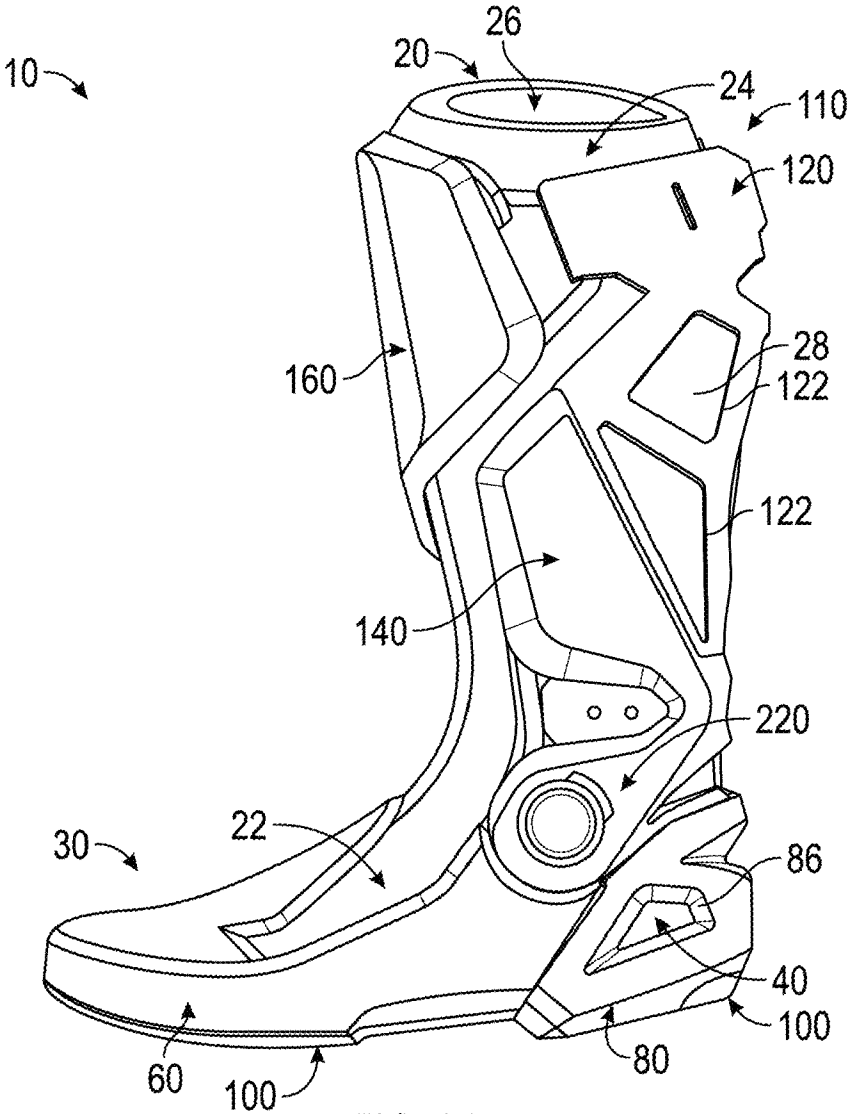
Figure 22:
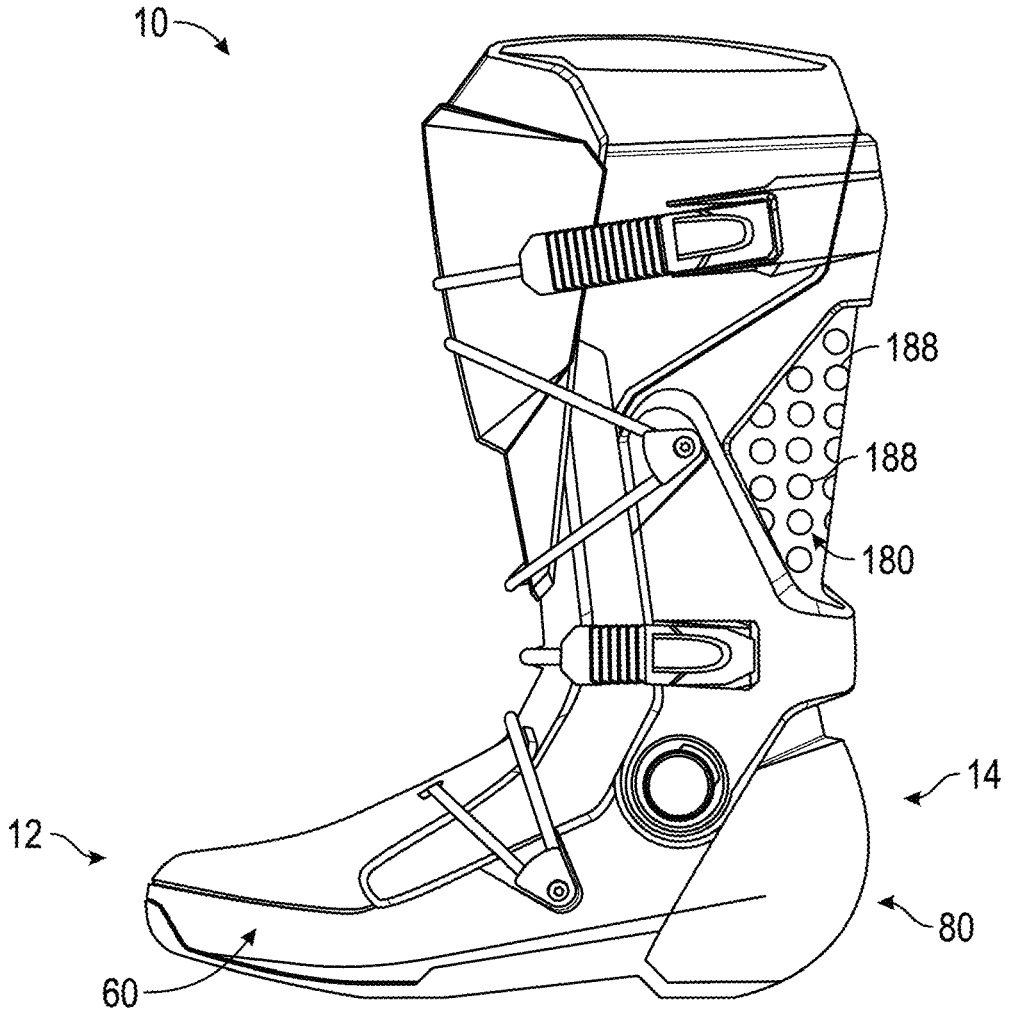
FIG. 22 is a lateral view of the protective footwear of FIG. 1, according to another example embodiment.
Figure 23:
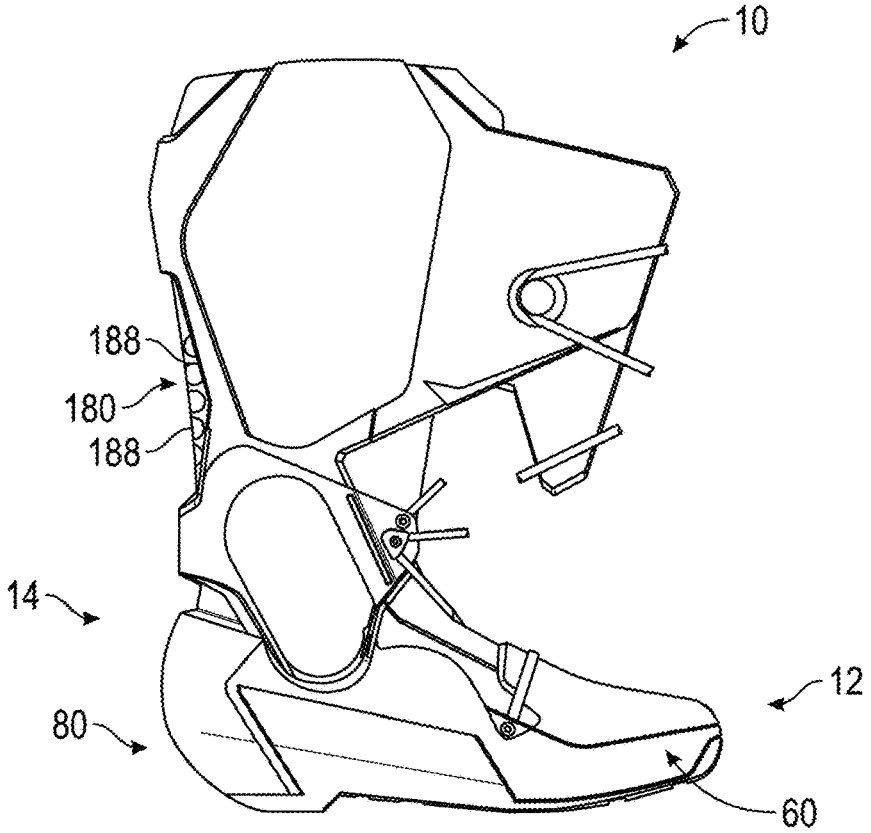
FIG. 23 is a medial view of the protective footwear of FIG. 22, according to an example embodiment.

As shown in FIGS. 1, 2, 15, 16, 22, 23, and 36-40, the calf guard 180 is disposed along a rear portion, the lateral side 16, and the medial side 18 of the lower-leg engagement portion 110 (e.g., to correspond in location to a calf region of a wearer of the protective footwear 10, etc.). According to an example embodiment, the calf guard 180 is manufactured from TPU. In other embodiments, the calf guard 180 is manufactured from another suitable material such as polypropylene ("PP"), thermoplastic rubber ("TPR"), TPE, TPU, nylon, and/or still other materials. As shown in FIGS. 1 and 15, the calf guard 180 defines a plurality of apertures, shown as calf apertures 182. According to an example embodiment, the calf apertures 182 are positioned to align with the calf apertures 122 of the calf cage 120 such that the portion 28 of the core 20 is exposed to an external environment (e.g., the portion 28 forms at least a portion of the exterior of the protective footwear 10, etc.). According to an example embodiment, the calf apertures 182 and/or the calf apertures 122 are configured to expose the core 20 for ventilation and/or reduce the weight of the protective footwear 10. As shown in FIGS. 22. 23, and 36-40, the calf guard 180 defines a plurality of perforations, shown as perforations 188. The perforations 188 may be configured to expose the core 20 for ventilation and/or reduce the weight of the protective footwear 10.

As shown in FIG. 1, the calf guard 180 defines an eighth interface, shown as second buckle interface 186. In an alternative embodiment, the second buckle interface 186 replaces the fourth intermediate cable interface 166. In yet another alternative embodiment, the calf guard 180 does not define the second buckle interface 186. According to an example embodiment, the second buckle interface 186 is positioned on an opposing lateral half of the protective footwear 10 relative the fourth intermediate cable interface 166 and the second cable end interface 154. According to the example embodiment shown in FIG. 1, the second buckle interface 186 is positioned on the lateral side 16 of the protective footwear 10. In other embodiments, the second buckle interface 186 is positioned on the medial side 18 of the protective footwear 10.

As shown in FIGS. 1, 2, 12-16, 18-21, and 25, the rubber sections 100 are variously positioned about the protective footwear 10. As shown in FIGS. 1, 2, 19, and 20, the mud guard 60 includes a first rubber portion of the rubber sections 100, shown as toe rubber section 102, disposed about the toe end 12 of the protective footwear 10. As shown in FIGS. 1, 2, 18-20, and 25, the mud guard 60 and/or the heel cap 80 include a second rubber portion of the rubber sections 100, shown as bottom rubber section 104, disposed about the bottom of the protective footwear 10. As shown in FIGS. 1, 2, and 19-21, the heel cap 80 includes a third rubber portion of the rubber sections 100, shown as heel rubber section 106, disposed about the heel end 14 of the protective footwear 10. According to an example embodiment, the toe rubber section 102, the bottom rubber section 104, and/or the heel rubber section 106 form at least a portion of an outsole of the protective footwear 10. The toe rubber section 102, the bottom rubber section 104, and/or the heel rubber section 106 may provide enhanced grip, durability, water resistance and/or still other advantages.

As shown in FIGS. 2, 18, and 25, the mud guard 60 includes a fourth rubber portion of the rubber sections 100, shown as interior foot rubber section 108, disposed about the medial side 18 of the foot engagement portion 30 of the protective footwear 10; the cuff 140 includes a fifth rubber portion of the rubber sections 100, shown as interior ankle rubber section 158, disposed about the medial side 18 of the lower-leg engagement portion 110 of the protective footwear 10; and the calf guard 180 includes a sixth rubber portion of the rubber sections 100, shown as interior calf rubber section 184, disposed about the medial side 18 of the lower-leg engagement portion 110 of the protective footwear 10. Traditionally, protective footwear (e.g., motocross boots, etc.) only include a rubber section positioned on the interior calf area of the footwear. According to an example embodiment, having the rubber sections 100 (e.g., the interior foot rubber section 108, the interior ankle rubber section 158, and/or the interior calf rubber section 184, etc.) variously positioned along the entire medial side 18 of the protective footwear 10 provides increased grip (e.g., with a side of a dirt bike, etc.), increased heat resistance and/or protection (e.g., the rubber sections 100 function as burn guards, etc.), increased durability and/or wear resistance, and/or still other advantages.

Cable Closure System

As shown in FIGS. 1, 2, 7, and 8, the cable closure system 300 includes a first cable closure system, shown as foot cable closure system 310, and a second cable closure system, shown as lower-leg cable closure system 330. In other embodiments, the foot cable closure system 310 and the lower-leg cable closure system 330 form a single, continuous cable closure system. In still other embodiments, the cable closure system 300 includes three or more individual cable closure systems. In yet other embodiments, the cable closure system 300 does not include one of the foot cable closure system 310 and the lower-leg cable closure system 330 (e.g., only includes the foot cable closure system 310, etc.). According to an example embodiment, the foot cable closure system 310 is configured to facilitate at least partially securing the foot engagement portion 30 of the protective footwear 10 to a foot of a wearer of the protective footwear 10 and the lower-leg cable closure system 330 is configured to facilitate at least partially securing the lower-leg engagement portion 110 of the protective footwear 10 to a lower leg (e.g., calf, shin, etc.) of a wearer of the protective footwear 10.

As shown in FIGS. 1, 2, 7, and 8, the foot cable closure system 310 includes a first fastener, shown as first cable end anchor 312; a first cable guide, shown as first intermediate cable guide 314; a second cable guide, shown as second intermediate cable guide 316; a first cable tightening device, shown as foot buckle device 318; and a first cable, shown as foot cable 320. As shown in FIGS. 1-3, 5, 7, and 8, the foot cable 320 includes a first end, shown as first end 322, coupled to the first cable end interface 62 and an opposing second end, shown as second end 324, coupled to the foot buckle device 318.

Figure 3:
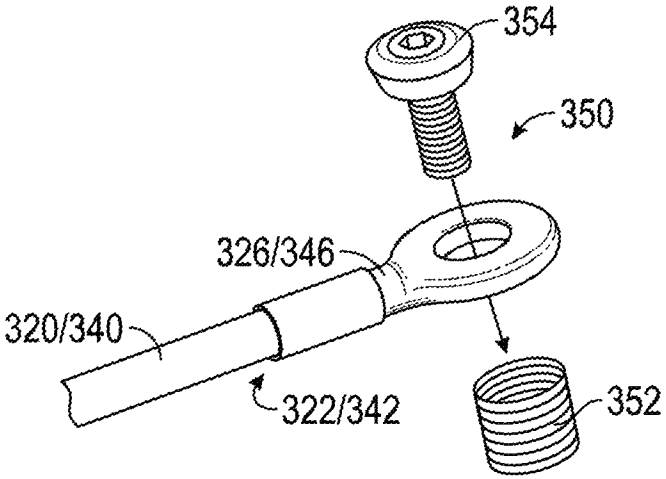
FIG. 3 is a detailed view of a cable end coupler of the cable closure system of FIG. 1, according to an example embodiment.

As shown in FIG. 2, the first cable end anchor 312 includes a first coupler, shown as first cable end coupler 350, positioned to removably couple the first end 322 of the foot cable 320 to the first cable end interface 62. As shown in FIG. 3, the first cable end coupler 350 includes a receiver, shown as threaded insert 352, and a fastener (e.g., screw, bolt, rivet, etc.), shown as fastener 354, configured to be removably received by the threaded insert 352. In other embodiments, the first cable end coupler 350 is otherwise structured (e.g., a clip device, a hook device, etc.). As shown in FIG. 3, the foot cable 320 includes a first attachment member, shown as first cable retainer 326, coupled to the first end 322 of the foot cable 320. According to an example embodiment, the first cable retainer 326 is configured to receive the fastener 354 to releasably secure the first end 322 of the foot cable 320 to the first cable end interface 62.

Figure 4A:
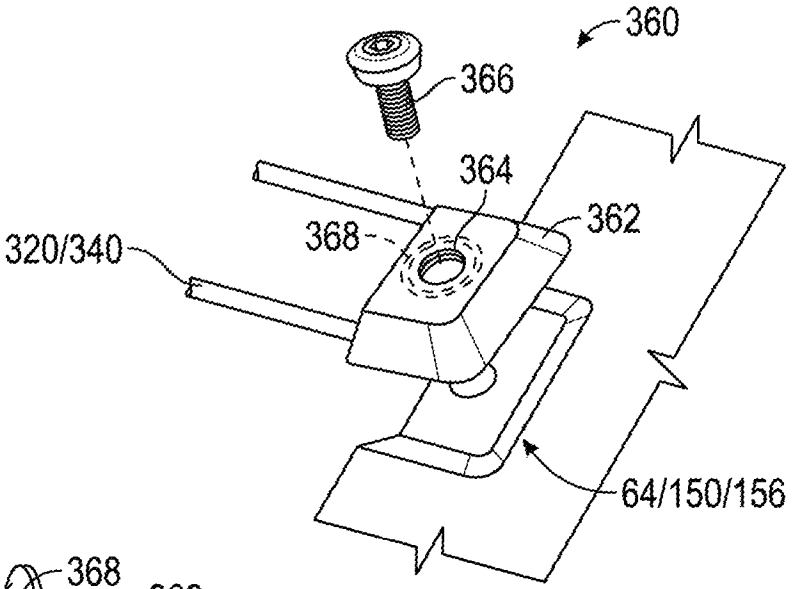
FIGS. 4A and 4B are detailed views of a cable guide of the cable closure system of FIG. 1, according to an example embodiment.
Figure 4B:
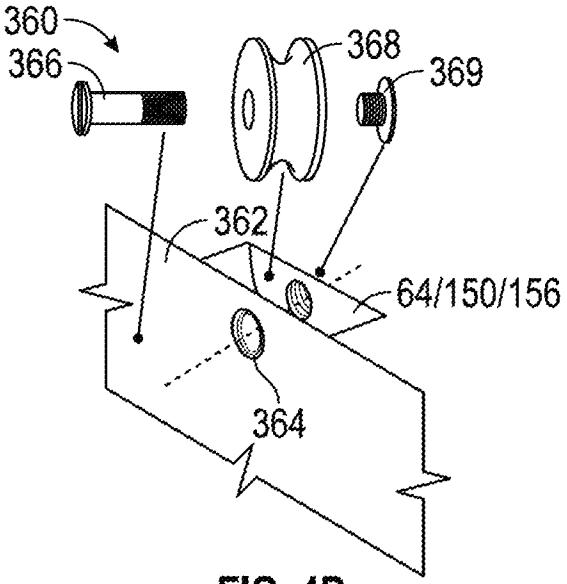
Figure 7:
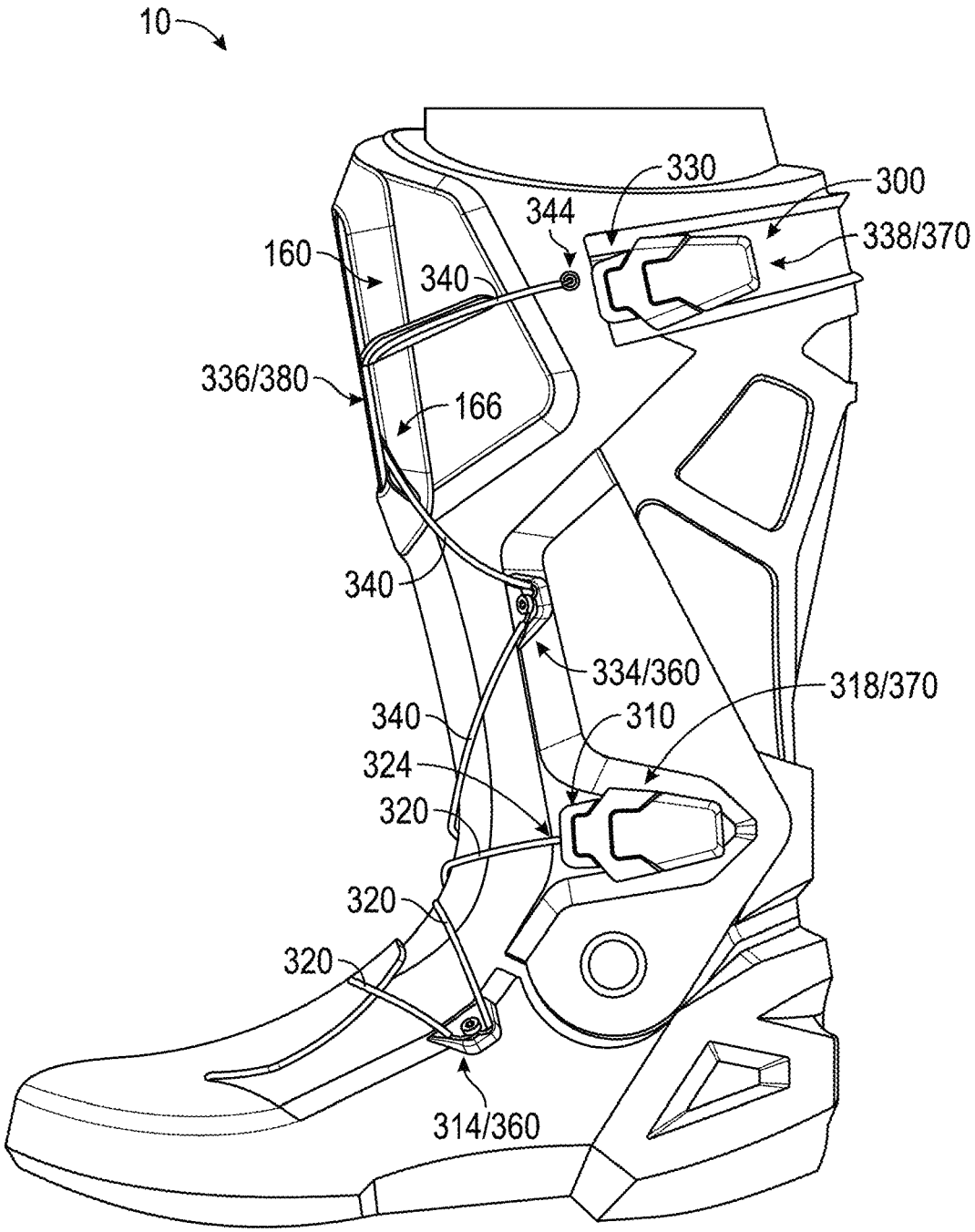
FIG. 7 is a lateral view of the protective footwear of FIG. 1, according to another example embodiment.
Figure 8:
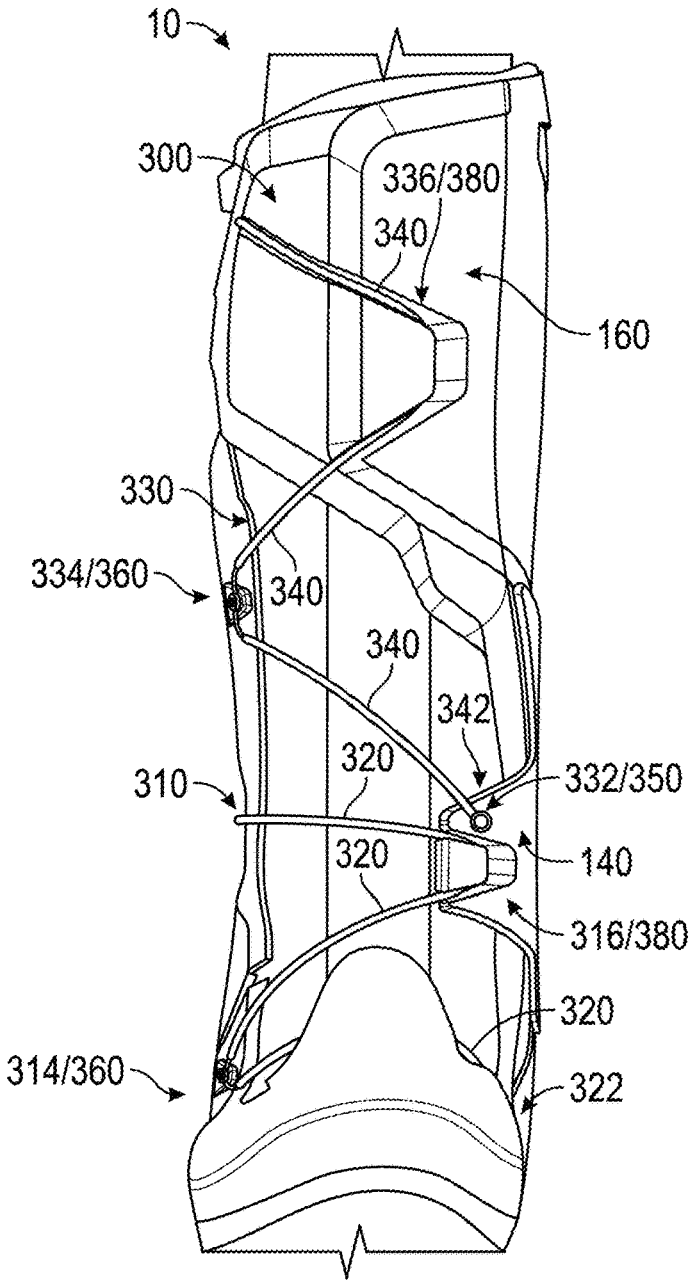
FIG. 8 is a front view of the protective footwear of FIG. 7, according to an example embodiment.

As shown in FIGS. 1, 7, and 8, the first intermediate cable guide 314 includes a guide assembly, shown as cable guide assembly 360, positioned to couple a first intermediate portion of the foot cable 320 to the first intermediate cable interface 64. As shown in FIGS. 4A and 4B, the cable guide assembly 360 includes a housing, shown as cable housing 362, defining an aperture, shown as housing aperture 364; a coupler, shown as fastener 366; an internal pulley, shown as cable bearing 368, disposed within the cable housing 362; and a receiver, shown as threaded insert 369, disposed within protective footwear 10 (e.g., at the first intermediate cable interface 64, the second intermediate cable interface 150, the third intermediate cable interface 156, etc.). According to an example embodiment, the housing aperture 364 of the cable housing 362 is configured to receive the fastener 366. The fastener 366 may thereby be configured to releasably couple the cable housing 362 to the first intermediate cable interface 64 by interfacing with and being received by the threaded insert 369. As shown in FIG. 4A, the cable housing 362 is configured to receive the first intermediate portion of the foot cable 320. According to an example embodiment, the cable bearing 368 is positioned to facilitate movement of the first intermediate portion of the foot cable 320 through the cable housing 362 during a tightening operation or a loosening operation of the foot cable closure system 310. In other embodiments, the first intermediate cable guide 314 includes a hook that is removably coupled to and/or that extends from the first intermediate cable interface 64 that is configured to receive the first intermediate portion of the foot cable 320. In still other embodiments, the foot cable closure system 310 does not include the first intermediate cable guide 314. Rather, the first intermediate cable interface 64 may define a recess that is positioned to receive the first intermediate portion of the foot cable 320.

Figure 9:
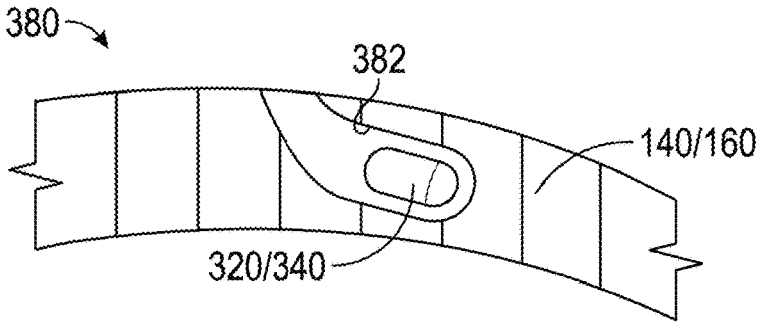
FIG. 9 is a detailed cross-section view of a cable guide of the protective footwear of FIG. 7, according to an example embodiment.
Figure 11:
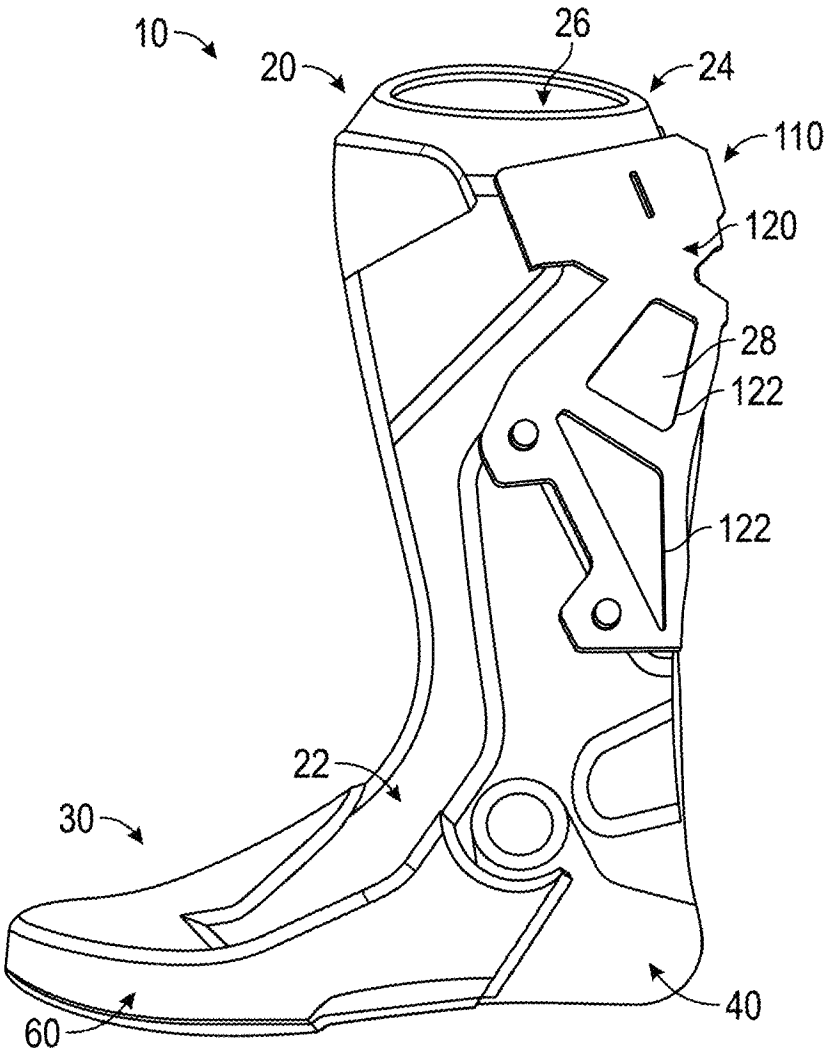
FIGS. 10-18 are various views of the construction of the protective footwear of FIG. 1, according to an example embodiment.
Figure 10:
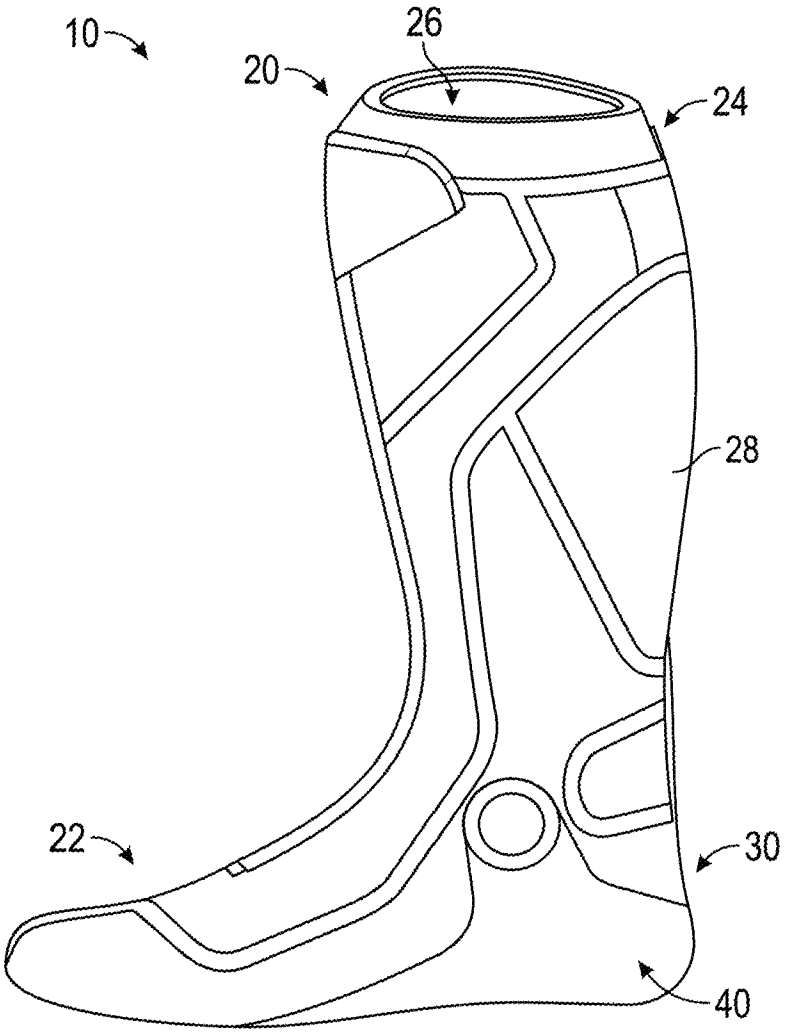
Figure 13:
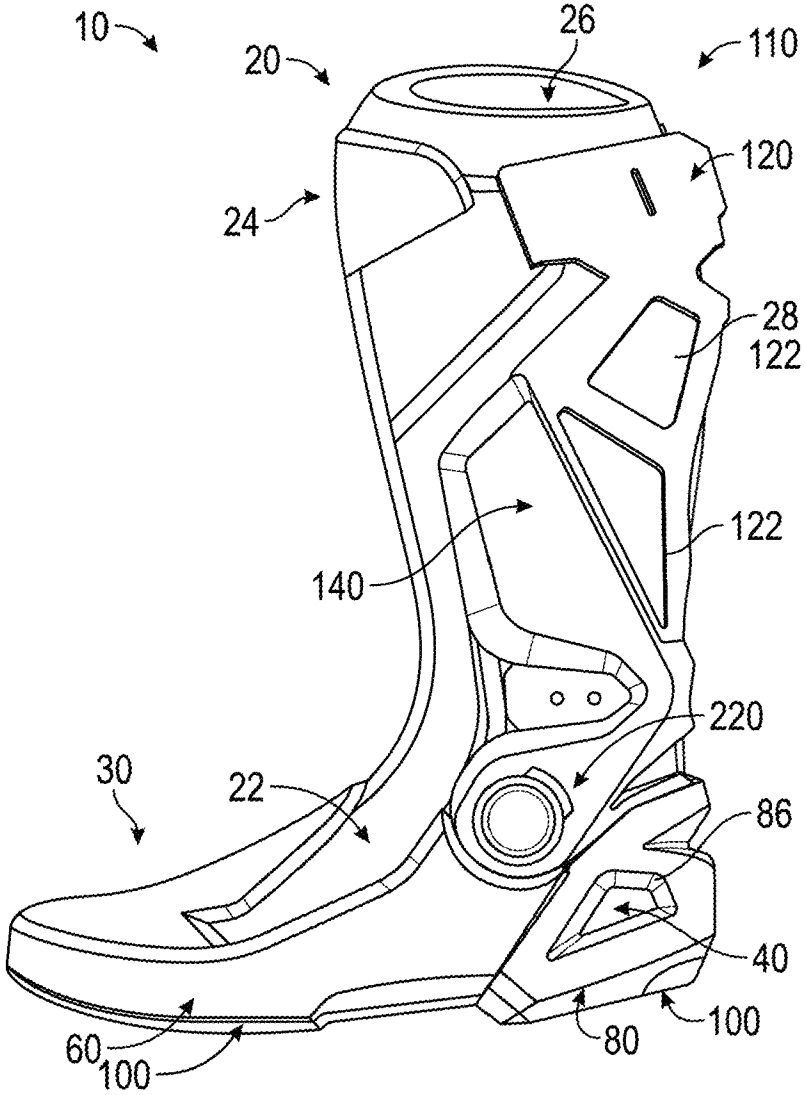
Figure 12:
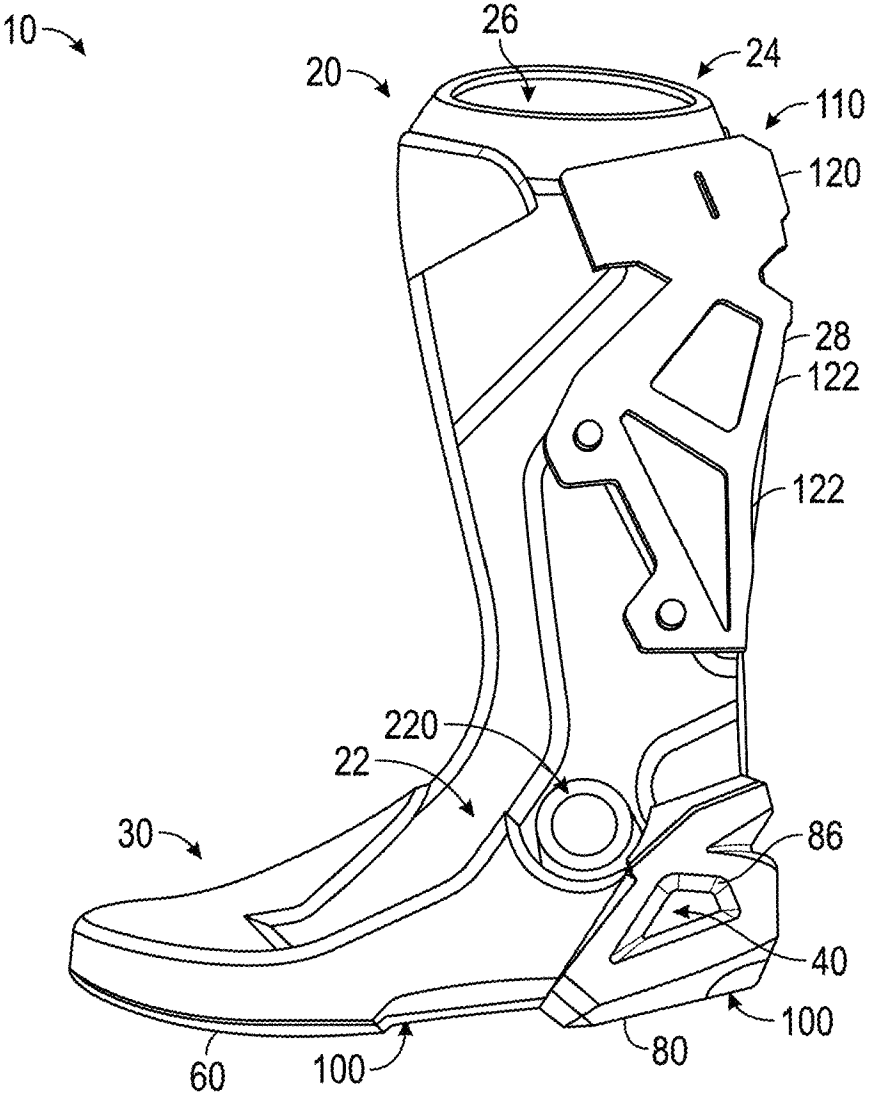

As shown in FIG. 2, the second intermediate cable guide 316 includes the cable guide assembly 360 positioned to couple a second intermediate portion of the foot cable 320 to the second intermediate cable interface 150. According to an example embodiment, the housing aperture 364 of the cable housing 362 is configured to receive the fastener 366. The fastener 366 may thereby be configured to releasably couple the cable housing 362 to the second intermediate cable interface 150 by interfacing with and being received by the threaded insert 369. As shown in FIG. 4A, the cable housing 362 is configured to receive the second intermediate portion of the foot cable 320. According to an example embodiment, the cable bearing 368 is positioned to facilitate movement of the second intermediate portion of the foot cable 320 through the cable housing 362 during a tightening operation or a loosening operation of the foot cable closure system 310. In other embodiments, the second intermediate cable guide 316 includes a hook that is removably coupled to and/or that extends from the second intermediate cable interface 150 that is configured to receive the second intermediate portion of the foot cable 320. As shown in FIG. 8, the foot cable closure system 310 does not include the second intermediate cable guide 316, rather, the second intermediate cable interface 150 defines a recess, shown as cable recess 380. As shown in FIGS. 8 and 9, the cable recess 380 is positioned to receive the second intermediate portion of the foot cable 320.

Figure 5:
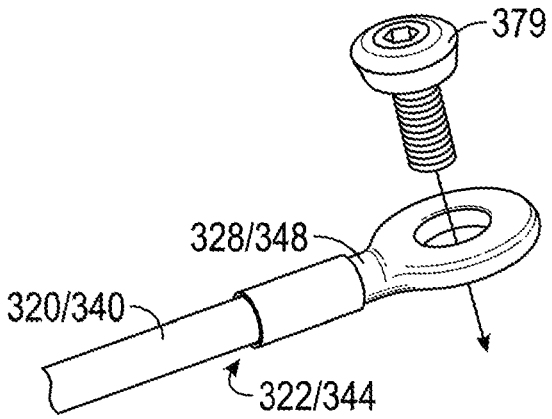
FIG. 5 is a detailed view of a cable buckle coupler of the cable closure system of FIG. 1, according to an example embodiment.
Figure 6:
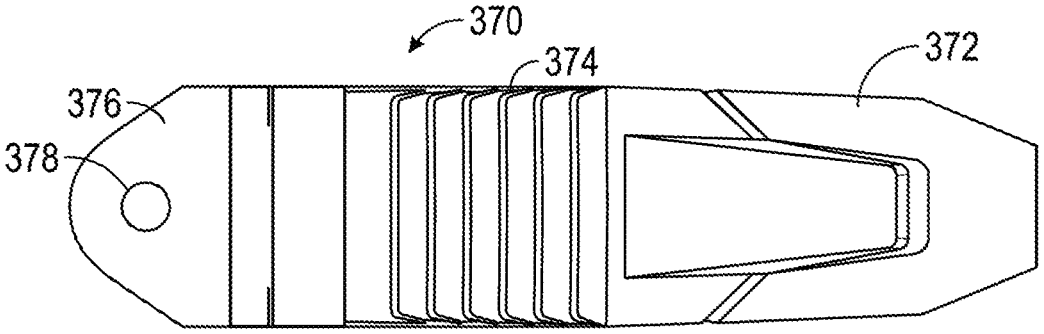
FIG. 6 is a detailed view of a buckle assembly for the cable closure system of FIG. 1, according to an example embodiment.

As shown in FIGS. 1 and 7, the foot buckle device 318 includes a buckle assembly, shown as ratchet buckle assembly 370, configured to couple to the first buckle interface 152 and facilitate tightening the foot cable closure system 310. As shown in FIG. 6, the ratchet buckle assembly 370 includes a coupler, shown as clasp 372, and a strap, shown as ratchet strap 374, extending from the clasp 372. According to an example embodiment, the clasp 372 is configured to releasably couple to the first buckle interface 152. In some embodiments, the clasp 372 may be used to ratchet the ratchet strap 374 of the ratchet buckle assembly 370 to tighten or loosen the foot cable closure system 310. As shown in FIG. 6, an end, shown as end 376, of the ratchet strap 374 defines an interface, shown as aperture 378. As shown in FIG. 5, the foot cable 320 includes a second attachment member, shown as second cable retainer 328, coupled to the second end 324 of the foot cable 320. According to an example embodiment, the second cable retainer 328 of the foot cable 320 and the aperture 378 of the ratchet strap 374 are configured to receive a coupler, shown as fastener 379, to releasably secure the second end 324 of the foot cable 320 to the end 376 of the ratchet strap 374.

As shown in FIGS. 1, 2, 7, and 8, the lower-leg cable closure system 330 includes a second fastener, shown as second cable end anchor 332; a third cable guide, shown as third intermediate cable guide 334; a fourth cable guide, shown as fourth intermediate cable guide 336; a second cable tightening device, shown as lower-leg buckle device 338; and a second cable, shown as lower-leg cable 340. As shown in FIGS. 1-3, 5, 7, and 8, the lower-leg cable 340 includes a first end, shown as first end 342, coupled to the second cable end interface 154 and an opposing second end, shown as second end 344, coupled to the lower-leg buckle device 338.

As shown in FIG. 2, the second cable end anchor 332 includes the first cable end coupler 350 positioned to removably couple the first end 342 of the lower-leg cable 340 to the second cable end interface 154. As shown in FIG. 3, the lower-leg cable 340 includes a third attachment member, shown as third cable retainer 346, coupled to the first end 342 of the lower-leg cable 340. According to an example embodiment, the third cable retainer 346 is configured to receive the fastener 354 to releasably secure the first end 342 of the lower-leg cable 340 to the second cable end interface 154.

As shown in FIGS. 1, 7, and 8, the third intermediate cable guide 334 includes the cable guide assembly 360 positioned to couple a first intermediate portion of the lower-leg cable 340 to the third intermediate cable interface 156. According to an example embodiment, the housing aperture 364 of the cable housing 362 is configured to receive the fastener 366. The fastener 366 may thereby be configured to releasably couple the cable housing 362 to the third intermediate cable interface 156 by interfacing with and being received by the threaded insert 369. As shown in FIG. 4A, the cable housing 362 is configured to receive the first intermediate portion of the lower-leg cable 340. According to an example embodiment, the cable bearing 368 is positioned to facilitate movement of the first intermediate portion of the lower-leg cable 340 through the cable housing 362 during a tightening operation or a loosening operation of the foot cable closure system 310. In other embodiments, the third intermediate cable guide 334 includes a hook that is removably coupled to and/or that extends from the third intermediate cable interface 156 that is configured to receive the first intermediate portion of the lower-leg cable 340. In still other embodiments, the lower-leg cable closure system 330 does not include the third intermediate cable guide 334. Rather, the third intermediate cable interface 156 may define a recess that is positioned to receive the first intermediate portion of the lower-leg cable 340.

As shown in FIG. 2, the fourth intermediate cable guide 336 includes a guide device, shown as hook 337, positioned to extend from the second intermediate cable interface 150 to selectively receive and/or releasably couple a second intermediate portion of the lower-leg cable 340 to the fourth intermediate cable interface 166. According to an example embodiment, the hook 337 is releasably coupled to the fourth intermediate cable interface 166. In some embodiments, the hook 337 is integrally formed with the shin guard 160. In other embodiments, the fourth intermediate cable guide 336 includes the cable guide assembly 360. As shown in FIGS. 7 and 8, the foot cable closure system 310 does not include the fourth intermediate cable guide 336, rather, the fourth intermediate cable interface 166 defines a recess, shown as cable recess 380. As shown in FIGS. 8 and 9, the cable recess 380 is positioned to receive the second intermediate portion of the lower-leg cable 340.

As shown in FIGS. 1 and 7, the lower-leg buckle device 338 includes the ratchet buckle assembly 370 configured to couple to the second buckle interface 186 and facilitate tightening the lower-leg cable closure system 330. According to an example embodiment, the clasp 372 is configured to releasably couple to the second buckle interface 186. In some embodiments, the clasp 372 may be used to ratchet the ratchet strap 374 of the ratchet buckle assembly 370 to tighten or loosen the lower-leg cable closure system 330. As shown in FIG. 5, the lower-leg cable 340 includes a fourth attachment member, shown as fourth cable retainer 348, coupled to the second end 344 of the lower-leg cable 340. According to an example embodiment, the fourth cable retainer 348 of the lower-leg cable 340 and the aperture 378 of the ratchet strap 374 are configured to receive the fastener 379 to releasably secure the second end 344 of the lower-leg cable 340 to the end 376 of the ratchet strap 374.

According to an example embodiment, the use of the ratchet buckle assemblies 370 having linear ratcheting/actuation provides increased load bearing capability (e.g., relative to rotational ratchet devices, etc.). According to an example embodiment, the first cable end interface 62 (i.e., the first cable end anchor 312), the first intermediate cable interface 64 (i.e., the first intermediate cable guide 314), the second intermediate cable interface 150 (i.e., the second intermediate cable guide 316), the first buckle interface 152 (i.e., the foot buckle device 318), the second cable end interface 154 (i.e., the second cable end anchor 332), the third intermediate cable interface 156 (i.e., the third intermediate cable guide 334), the fourth intermediate cable interface 166 (i.e., the fourth intermediate cable guide 336), and the second buckle interface 186 (i.e., the lower-leg buckle device 338) are positioned at specific locations about the protective footwear 10 and oriented at specific angles relative to each other to provide equal pressure about the foot and lower-leg of a wearer of the protective footwear 10. In some embodiments, the foot buckle device 318 and/or the lower-leg buckle device 338 do not include the ratchet strap 374. By way of example, the foot buckle device 318 and/or the lower-leg buckle device 338 may include a cam mechanism.

In some embodiments, the cable closure system 300 includes a suspension system configured to prevent cable overextension and failure during a shock situation. By way of example, the foot cable 320 and/or the lower-leg cable 340 may be manufactured from an at least partially elastomeric material that facilitates extension thereof during high-loading situations to prevent failure (e.g., snapping, tearing, etc.). By way of another example, the cable guide assemblies 360 (e.g., of the first intermediate cable guide 314, the second intermediate cable guide 316, the third intermediate cable guide 334, etc.) may have an elastomeric arrangement and/or includes a resilient member (e.g., a spring, etc.) positioned to facilitate movement of the cable bearing 368 during high loading situations to absorb shock forces and prevent (i) failure of the foot cable 320 and/or the lower-leg cable 340 and/or (ii) disengagement of the foot buckle device 318 and/or the lower-leg buckle device 338.

Band Closure System

Figure 29:
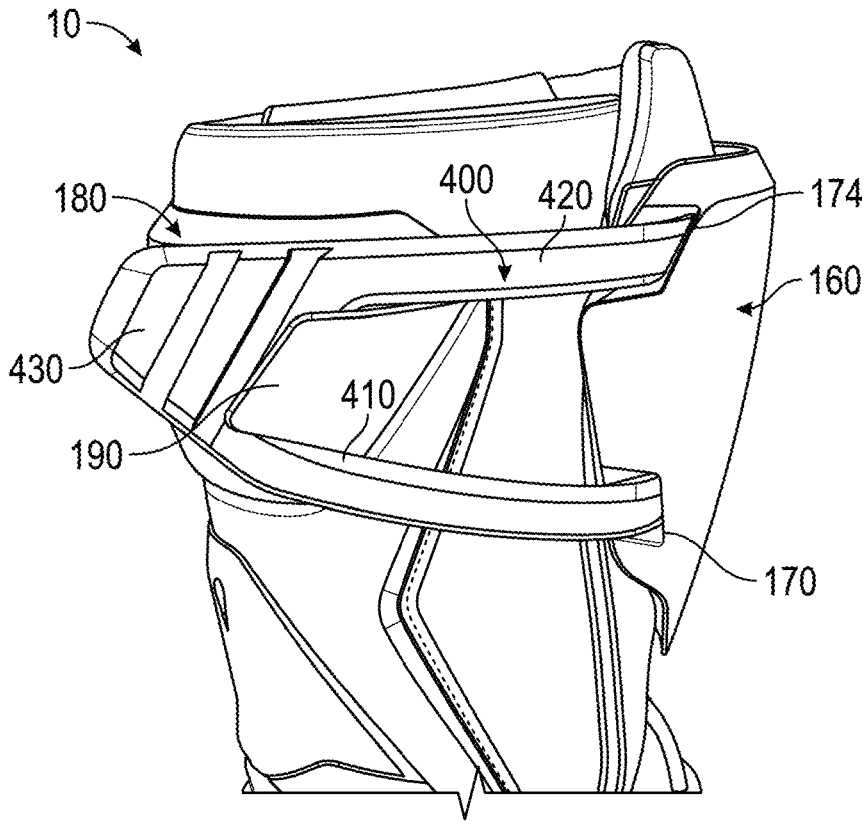
FIGS. 29-31 are various views of the protective footwear of FIG. 1 having a flexible band closure system, according to an example embodiment.
Figure 30:
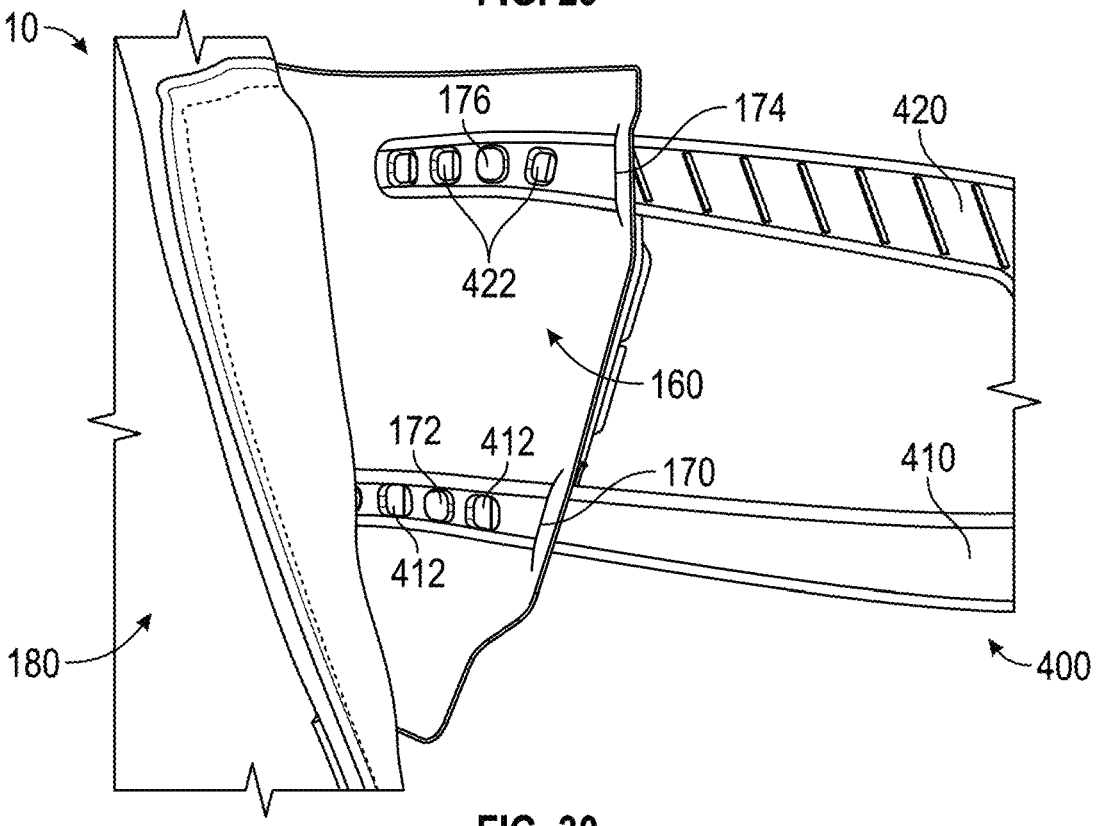
Figure 31:
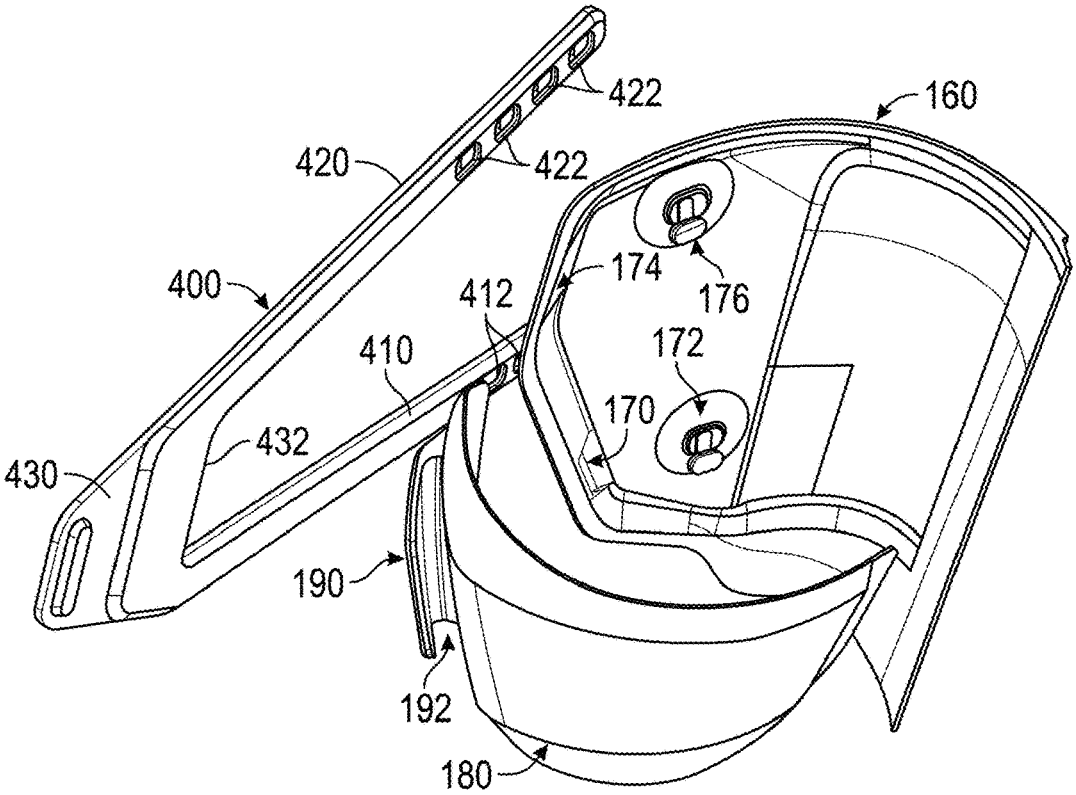

As shown in FIGS. 29-31, the protective footwear 10 additionally or alternatively includes the band closure system 400. By way of example, the band closure system 400 may replace the lower-leg cable closure system 330. By way of another example, the protective footwear 10 may not include the cable closure system 300, but rather include the band closure system 400 and one or more traditional ratchet strap devices. By way of yet another example, the protective footwear 10 may include one or more band closure systems 400 (e.g., one, two, three, etc.). According to an example embodiment, the band closure system 400 is configured to facilitate selectively closing the shin guard 160 and the calf guard 180 of the lower-leg engagement portion 110 together around a lower-leg of a wearer of the protective footwear 10. As shown in FIGS. 29-31, the shin guard 160 defines (i) a first coupler, shown as lower band retainer 172, disposed on and extending from an interior surface of the shin guard 160 and (ii) a second coupler, shown as upper band retainer 176, disposed on and extending from the interior surface of the shin guard 160. As shown in FIGS. 29-31, the shin guard 160 defines a first aperture, shown as lower band aperture 170, and a second band aperture, shown as upper band aperture 174. As shown in FIGS. 30 and 31, the lower band aperture 170 is positioned to align with the lower band retainer 172 and the upper band aperture 174 is positioned to align with the upper band retainer 176. As shown in FIGS. 29 and 31, the calf guard 180 defines a protrusion, shown as band interface 190, extending therefrom. As shown in FIG. 31, the band interface 190 defines a slot and hook, shown as band receiver 192.

As shown in FIGS. 29-31, the band closure system 400 includes a first arm or strap, shown as lower band 410; a second arm or strap, shown as upper band 420; and a retainer, shown as band retainer 430, connecting an end (e.g., a distal end, etc.) of each of the lower band 410 and the upper band 420 together (e.g., forming a U-shape, etc.). In other embodiments, the band closure system 400 includes one or more bands (e.g., one, three, etc.). According to an example embodiment, the lower band 410 and the upper band 420 are flexible and/or stretchable. By way of example, the lower band 410 and the upper band 420 may be manufactured from an elastic material (e.g., rubber, silicone, etc.). As shown in FIGS. 30 and 31, the lower band 410 defines a first plurality of apertures, shown as lower apertures 412, along a portion of the length of the lower band 410 (e.g., proximate the end opposite the band retainer 430, near a proximate end thereof, etc.) and the upper band 420 defines a second plurality of apertures, shown as upper apertures 422, along a portion of the length of the upper band 420 (e.g., proximate the end opposite the band retainer 430, near a proximate end thereof, etc.).

As shown in FIGS. 29 and 30, the lower band 410 and the upper band 420 are configured to extend through the lower band aperture 170 and the upper band aperture 174, respectively, such that the lower apertures 412 and the upper apertures 422 may be positioned to interface with the lower band retainer 172 and the upper band retainer 176. As shown in FIG. 30, one of the lower apertures 412 and one of the upper apertures 422 selectively receive the lower band retainer 172 and the upper band retainer 176, respectively, to secure the lower band 410 and the upper band 420 to the interior surface of the shin guard 160. According to an example embodiment, a wearer of the protective footwear can selectively adjust the band closure system 400 (e.g., tighten, loosen, etc.) by selectively choosing which of the lower apertures 412 and the upper apertures 422 the lower band retainer 172 and the upper band retainer 176 engage.

As shown in FIG. 31, the band retainer 430 defines an edge, shown as interior edge 432. According to an example embodiment, the interior edge 432 of the band retainer 430 is configured to be selectively received by the band receiver 192 of the band interface 190. As shown in FIG. 29, the band retainer 430 is configured to releasably engage with the band interface 190 to selectively close the shin guard 160 and the calf guard 180 of the lower-leg engagement portion 110 together and secure the protective footwear 10 to a leg of a wearer.

Ventilation System

According to an example embodiment, the ventilation system 500 is disposed within the foot engagement portion 30 of the protective footwear 10 and configured to facilitate (i) circulating fresh air from an external environment into the protective footwear 10 and (ii) removing warm and/or moist air from within the protective footwear 10 to the external environment. As shown in FIGS. 32-35, the ventilation system 500 includes one or more inlet vents, shown as intake vents 502; one or more outlet vents, shown as exhaust vents 506; and one or more tubes, shown as airflow conduits 510.

Figure 32:
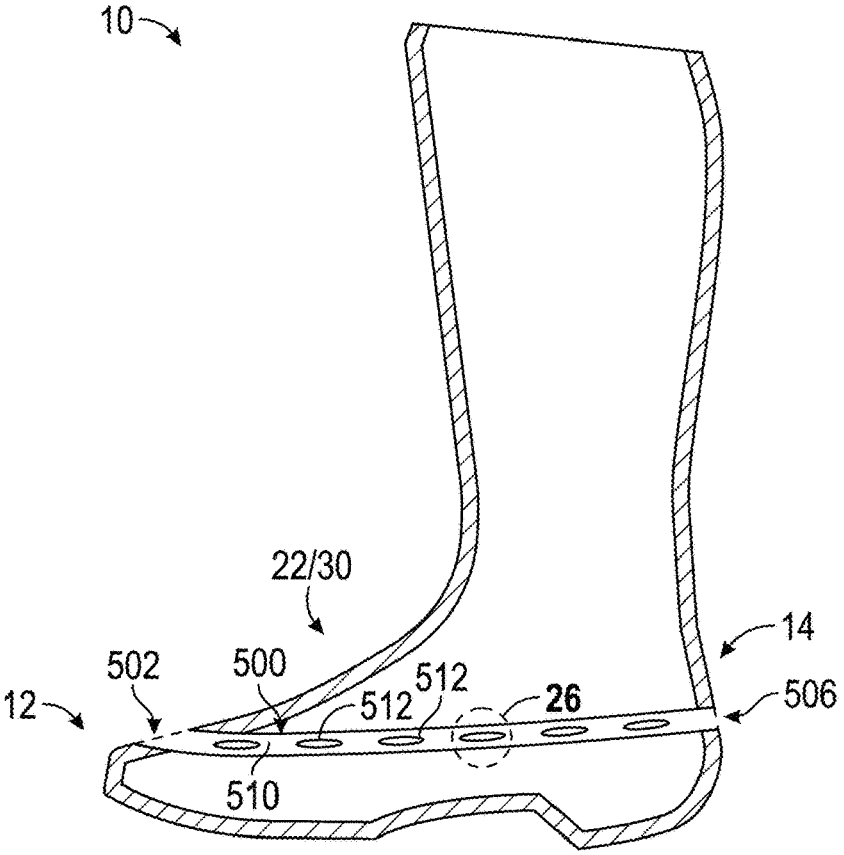
FIGS. 32-35 are various views of a ventilation system of the protective footwear of FIG. 1, according to an example embodiment.
Figure 34:
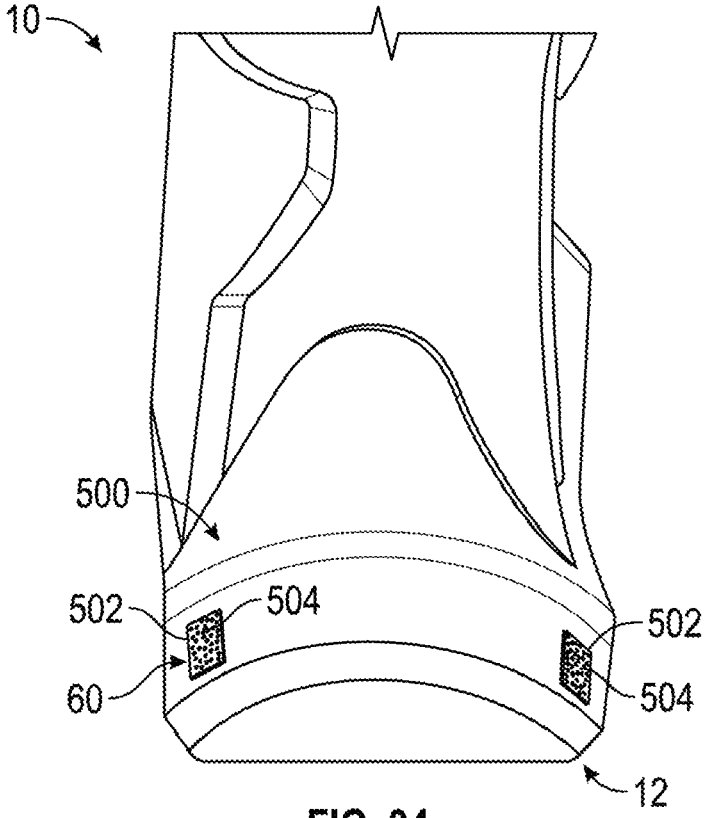

As shown in FIGS. 32 and 34, the intake vents 502 are positioned at the toe end 12 of the protective footwear 10 and disposed along and/or within the mud guard 60. According to an example embodiment, the intake vents 502 are positioned to receive an inlet airflow from the external environment. As shown in FIG. 34, the intake vents 502 each include a permeable cover, shown as intake vent cover 504. According to an example embodiment, the intake vent covers 504 are configured to be highly breathable, but highly resistant to water and/or debris (e.g., dirt, dust, mud, etc.). The intake vent covers 504 may thereby prevent debris, dirt, mud, water, etc. from entering the interior cavity 32 of the foot engagement portion 30 of the protective footwear 10 through the intake vents 502.

Figure 35:
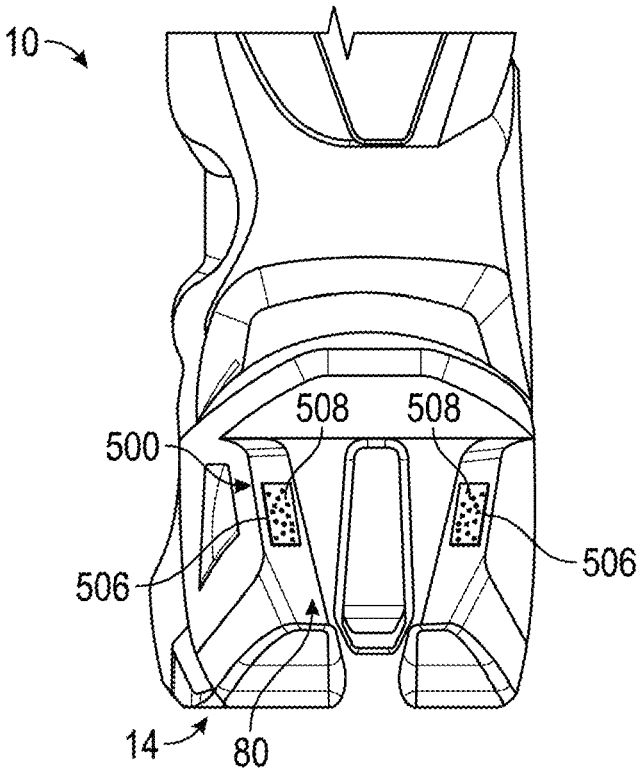
Figure 36:
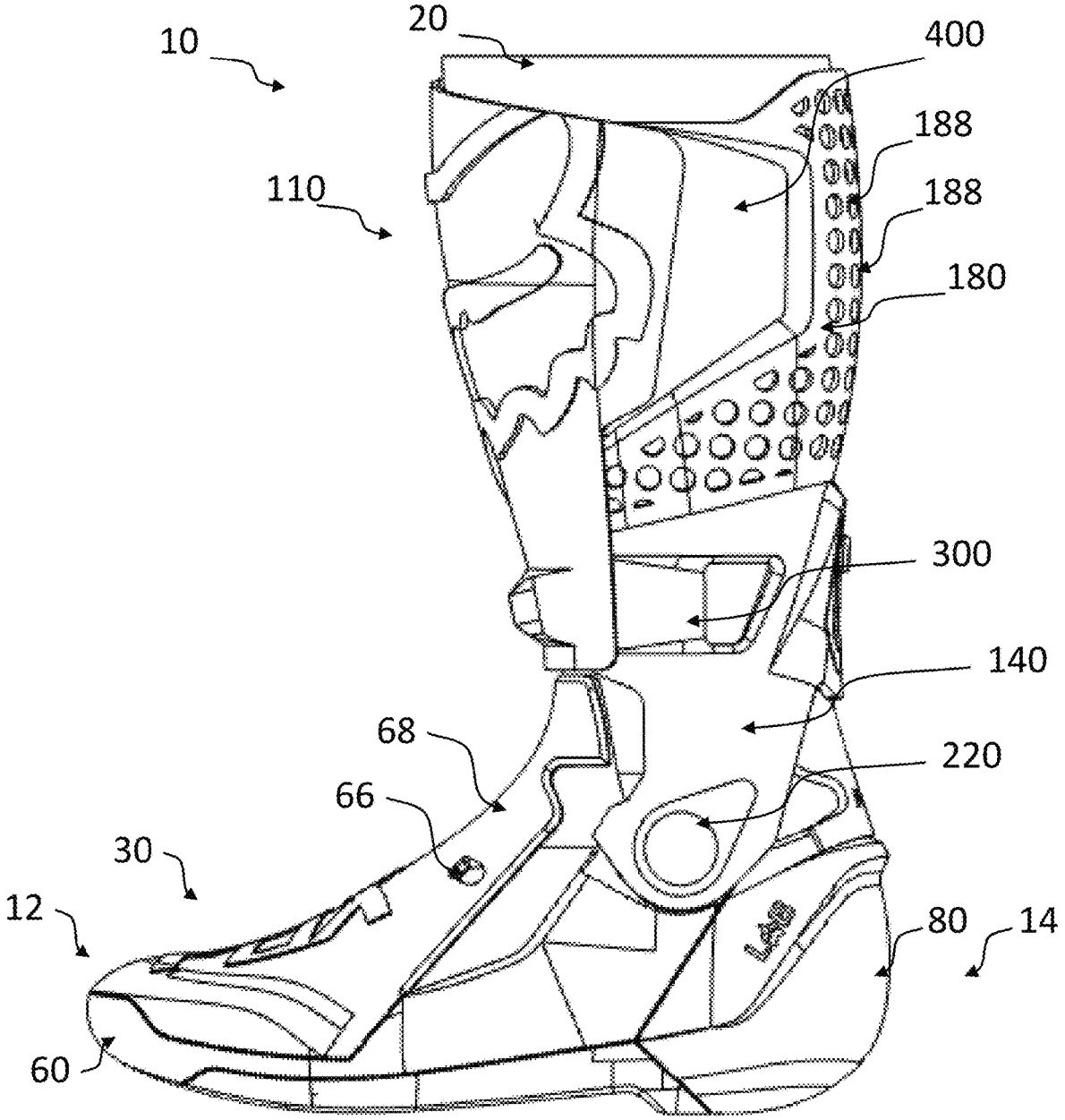
FIG. 36 is a lateral view of the protective footwear of FIG. 1, according to another example embodiment.
Figure 37:
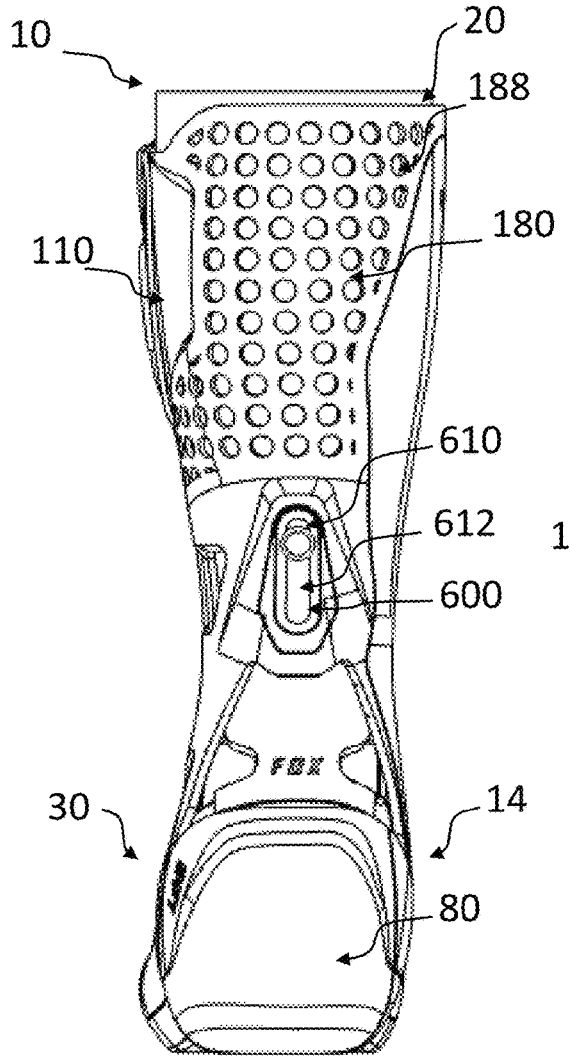
FIG. 37 is a rear view of the protective footwear of FIG. 36, according to an example embodiment.
Figure 38:
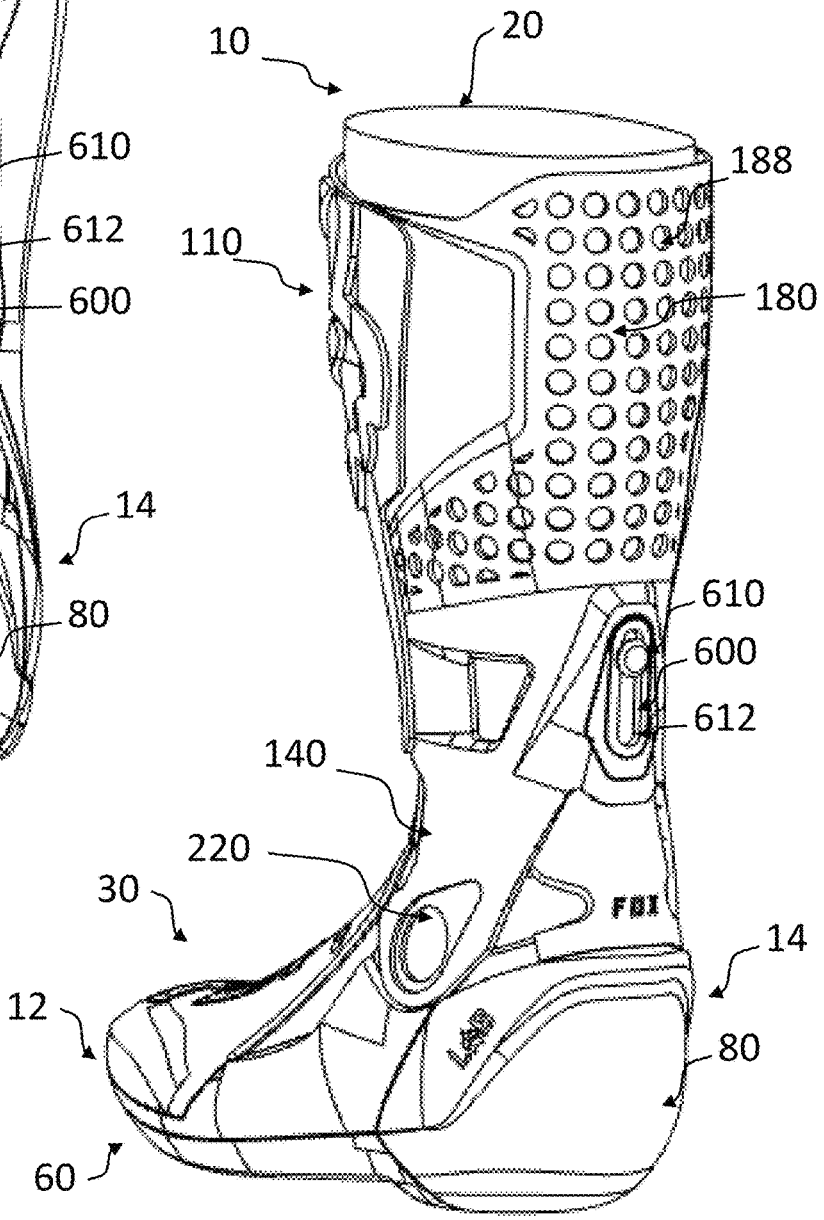
FIG. 38 is a rear perspective view of the protective footwear of FIG. 36, according to an example embodiment.
Figure 39:
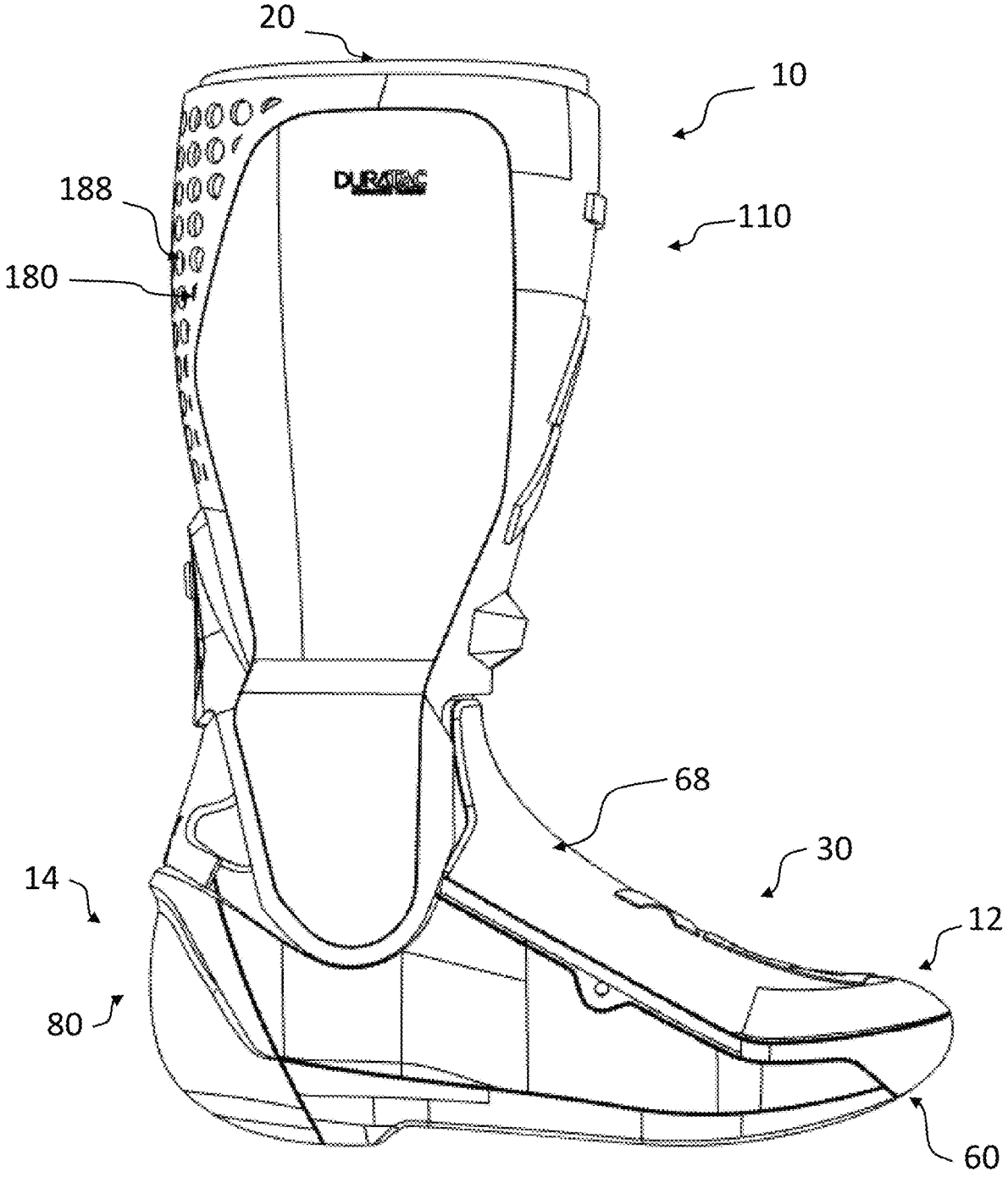
FIG. 39 is a medial view of the protective footwear of FIG. 36, according to an example embodiment.
Figure 40:
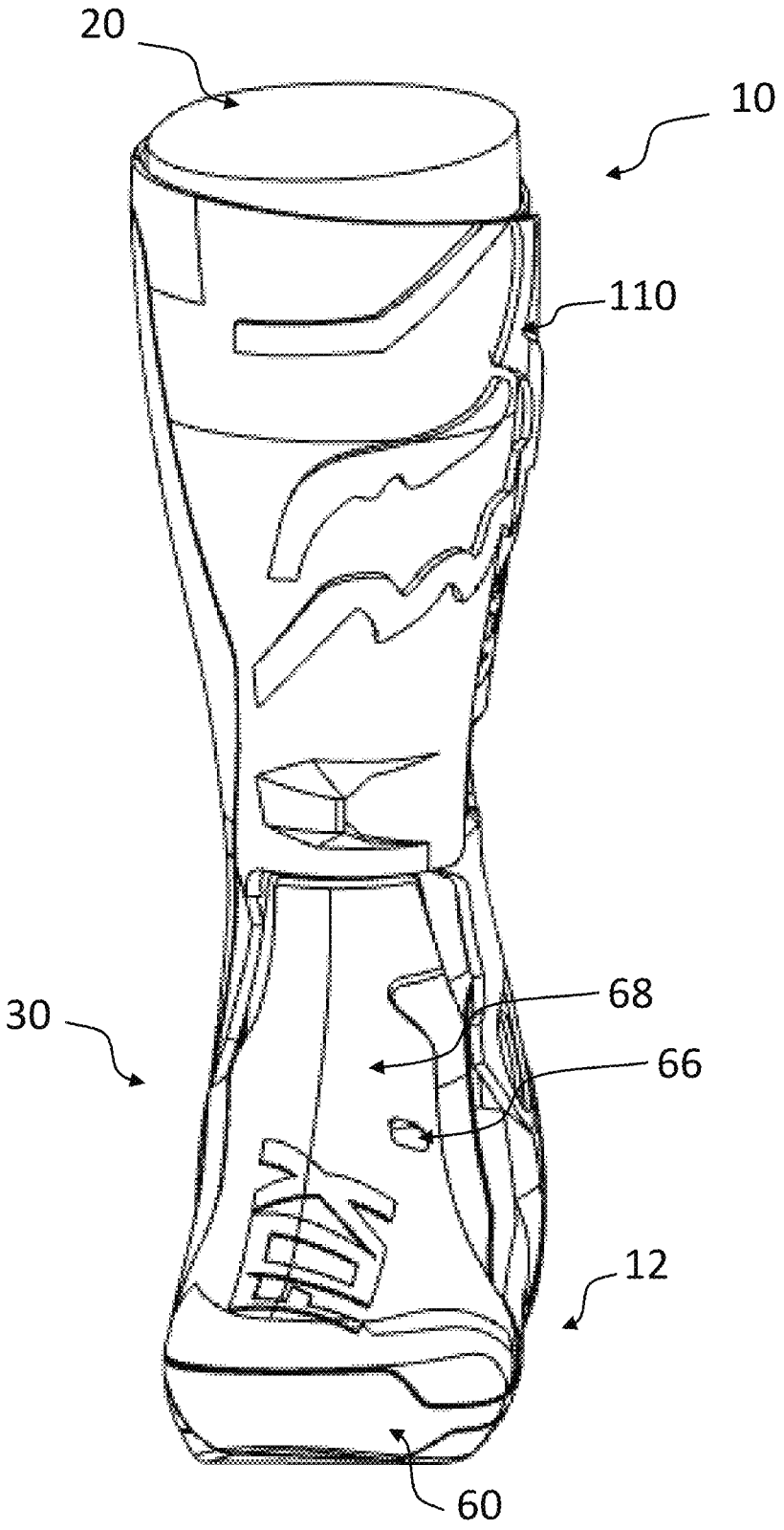
FIG. 40 is a front view of the protective footwear of FIG. 36, according to an example embodiment.

As shown in FIGS. 32 and 35, the exhaust vents 506 are positioned at the heel end 14 of the protective footwear 10 and disposed along and/or within the heel cap 80. According to an example embodiment, the exhaust vents 506 are positioned to facilitate the exit of air (e.g., warm, moist, etc. air) from the interior cavity 32 of the foot engagement portion 30 to the external environment. As shown in FIG. 35, the exhaust vents 506 each include a permeable cover, shown as exhaust vent cover 508. According to an example embodiment, the exhaust vent covers 508 are configured to be highly breathable, but highly resistant to water and/or debris (e.g., dirt, dust, mud, etc.). The exhaust vent covers 508 may thereby prevent debris, dirt, mud, water, etc. from entering the interior cavity 32 of the foot engagement portion 30 of the protective footwear 10 through the exhaust vents 506.

Figure 33:
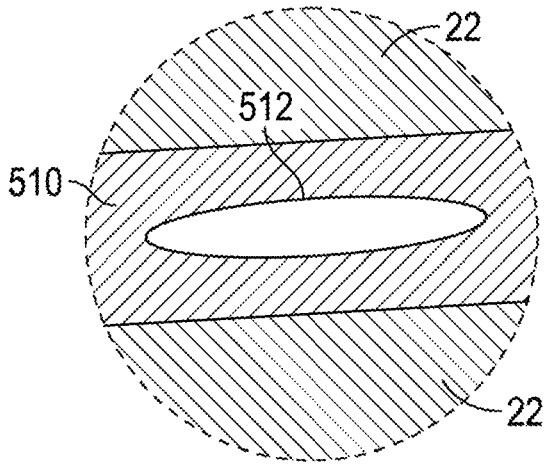

As shown in FIG. 32, each of the airflow conduits 510 extends along the interior cavity 32 of the foot engagement portion 30 between a respective intake vent 502 and a respective exhaust vent 506. As shown in FIG. 33, the airflow conduits 510 are disposed within the foot portion 22 of the core 20 (e.g., the sidewall thereof, etc.). According to an example embodiment, the airflow conduits 510 are manufactured from a material that is sturdy enough to maintain its shape, but soft enough to be comfortable against a foot and/or leg of the wearer of the protective footwear 10. By way of example, the airflow conduits 510 may be manufactured from neoprene, latex, silicone, fabric, PU, PP, TPE, TPU, foam, and/or still another material. As shown in FIGS. 32 and 33, each of the airflow conduits 510 defines one or more slots, shown as slots 512, along a length thereof. According to an example embodiments, the slots 512 are positioned to facilitate the entry of the inlet airflow (e.g., fresh air, etc.) from a respective intake vent 502 into the interior cavity 32 of the foot engagement portion 30 (e.g., to cool the feet of the wearer, etc.) and facilitate the exit of an exit airflow (e.g., warm, moist, etc. air) from the interior cavity 32 of the foot engagement portion 30 through a respective exhaust vent 506.

Ankle Dampening System

As shown in at least FIGS. 36-40 and 43-46, the protective footwear 10 additionally or alternatively includes the ankle dampening system 600. The ankle dampening system 600 may provide for a set range of motion (e.g., a predetermined range of motion) for the wearer's ankle. When a limit (e.g., a predetermined limit) of the set range of motion is met, the ankle dampening system 600 may provide a dampening effect by allowing for additional (e.g., a small amount) motion beyond the limit. The dampening effect provided by the ankle dampening system 600 allows for a limited range of motion of the wearer's ankle, yet provides a more comfortable experience to the wearer, as rotation of the wearer's ankle would not come to a jarring stop, but rather a smooth stop when the limit of the set range of motion is met.

Figure 43:
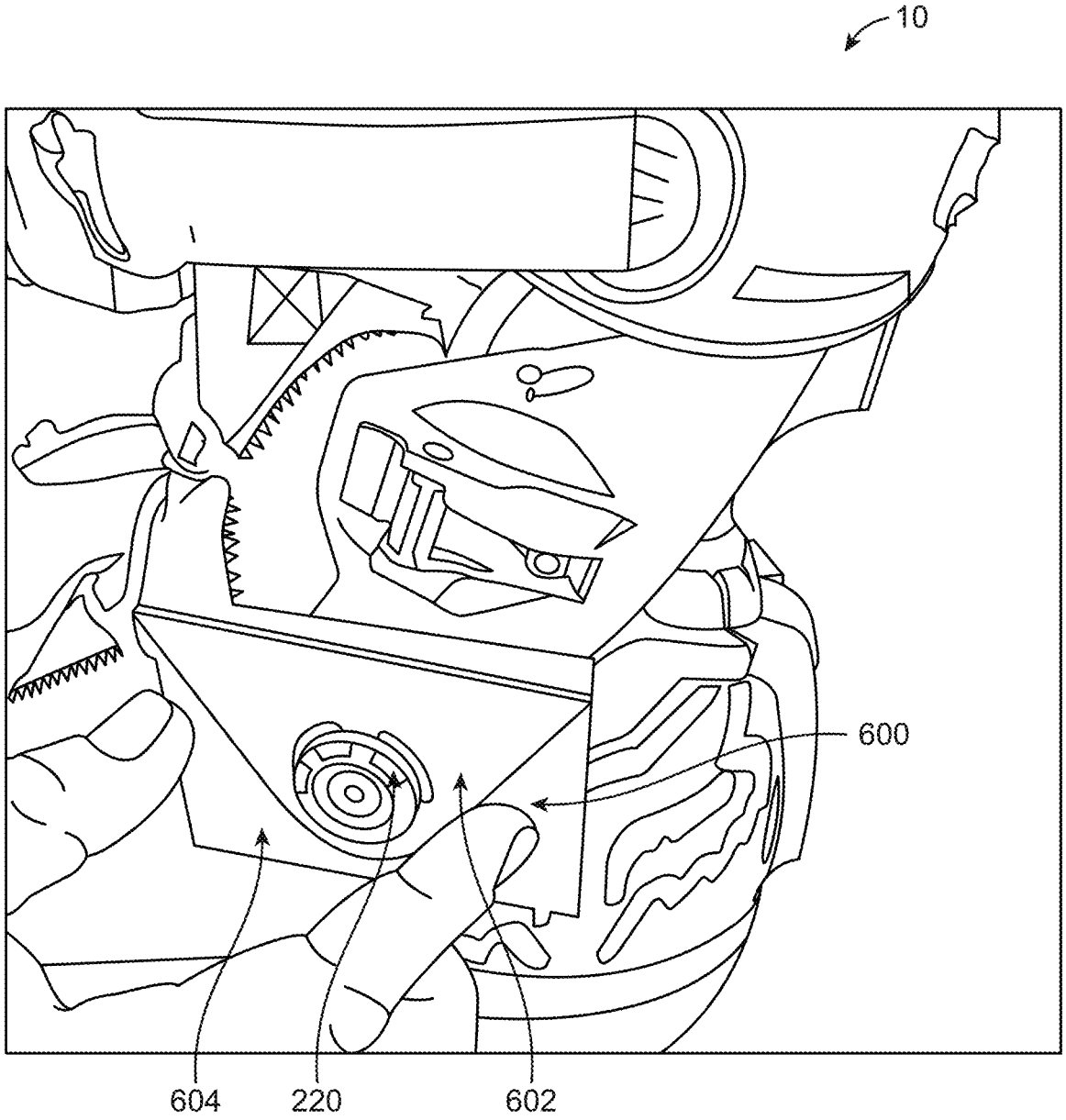
FIGS. 43-45 are detailed views of an ankle dampening system of the protective footwear of FIG. 36, according to an example embodiment.
Figure 44:
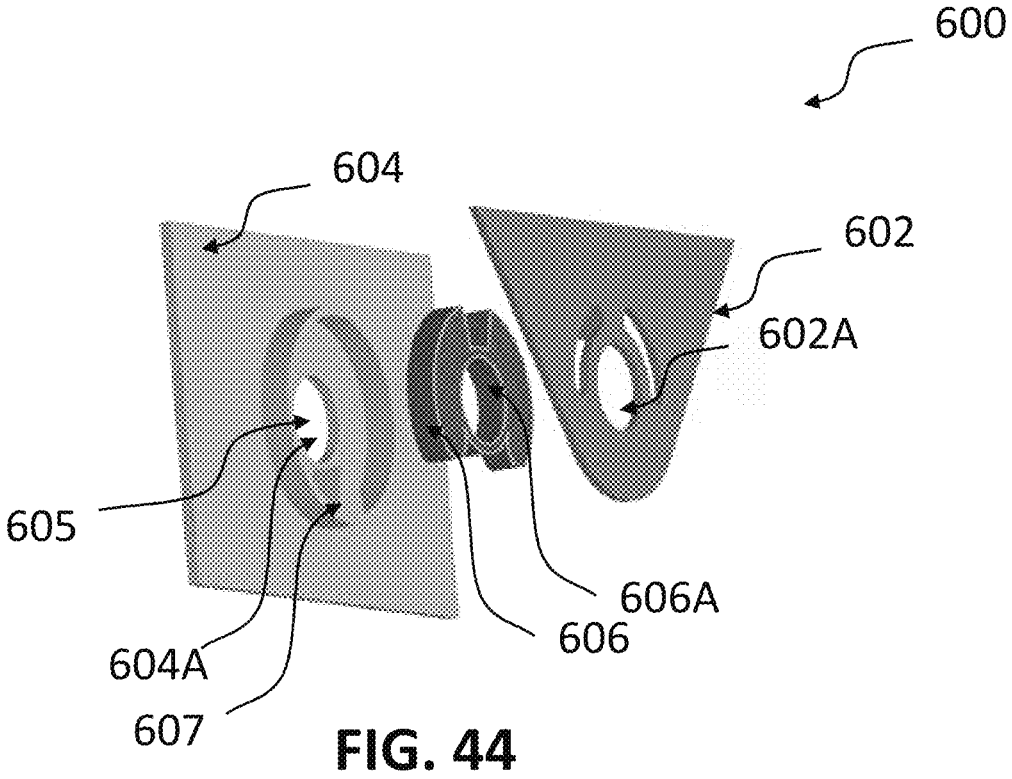
Figure 45:
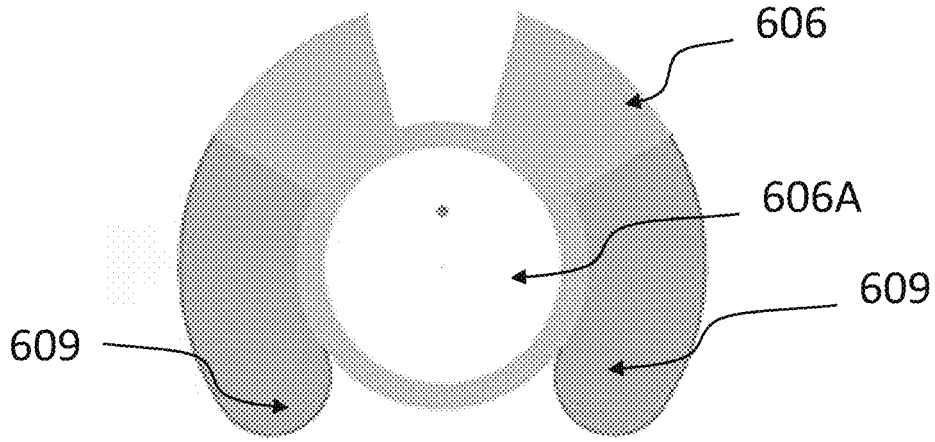

FIGS. 43-46 illustrate an example embodiment of the ankle dampening system 600. For example, FIG. 43 illustrates an example embodiment of the ankle dampening system 600 coupled with the protective footwear 10, FIG. 44 illustrates a detailed view of the ankle dampening system 600, and FIG. 45 illustrates an exploded view of the ankle dampening system 600. As shown the ankle dampening system 600 can be coupled with the footwear 10, at for example, the pivotal hinge system 220. In some embodiments, the ankle dampening system 600 is implemented in addition to the pivotal hinge system 220 or replaces the pivotal hinge system 220. The ankle dampening system 600 can be implemented as an integrated bracket on the pivotal hinge system 220. The ankle dampening system 600 can define an elastomeric sprocket that allows for freedom of movement to a point whereupon a dampener limits a small amount of movement. For example, the ankle dampening system 600 includes a dampening system support 604, a hinge bumper 606, and an enclosure plate 602. The dampening system support 604, the hinge bumper 606, and the enclosure plate 602 may include central apertures 604A, 606A, 602A that are axially aligned and configured to surround at least a portion of the pivotal hinge system 220.

The dampening system support 604 may include a recess 605 that receives the hinge bumper 604. The recess 605 may include a notch 607 that extends from an outer perimeter of the recess 605 towards a center of the central aperture 604A. The notch 607 is configured to be positioned between legs 609 of the hinge bumper 606 to limit rotational movement of the lower-leg engagement portion 110 relative to the foot engagement portion 30, but provide a dampening effect when one of the legs 609 contacts the notch 607. The distance of the space provided between the legs 609 of the hinge bumper 606 may be the predetermined set range of motion of the additional rotational movement discussed above. The hinge bumper 606 may include various materials, such as plastic and may be formed by over-molding.

FIGS. 36-40 illustrate another example of the ankle dampening system 600. The ankle dampening system 600 can include a fastener (e.g., a bolt) 610 and a calf support element 612 (e.g., an elastomeric material) defining a recess in which the bolt 610 resides. The ankle dampening system 600 may allow for adjustment of the amount of dampening and/or amount of additional allowed rotational movement beyond the set range of motion (e.g., throw movement once the limit of the range of motion is met).

It is important to note that the construction and arrangement of the elements of the systems, methods, and apparatuses as shown in the example embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. It should be noted that the elements and/or assemblies of the enclosure may be constructed from any of a wide variety of materials that provide sufficient strength or durability, in any of a wide variety of colors, textures, and combinations.

Embodiments have been described in connection with the accompanying drawings. However, it should be understood that the figures are not drawn to scale. Distances, angles, shapes, etc. are merely illustrative and do not necessarily bear an exact relationship to actual dimensions and layout of the articles that are illustrated. In addition, the foregoing embodiments have been described at a level of detail to allow one of ordinary skill in the art to make and use the articles, parts, different materials, etc. described herein. A wide variety of variation is possible. Articles, materials, elements, and/or steps can be altered, added, removed, or rearranged. While certain embodiments have been explicitly described, other embodiments will become apparent to those of ordinary skill in the art based on this disclosure.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or configurations are in any way required for one or more embodiments. The terms "comprising," "including," "having," and the like are synonymous and are used inclusively, in an open-ended fashion, and do not exclude additional elements, features, acts, operations, and so forth. The term "consisting essentially of" can be used anywhere where the terms comprising, including, containing or having are used herein, but consistent essentially of is intended to mean that the claim scope covers or is limited to the specified materials or steps recited and those that do not materially affect the basic and novel characteristic(s) of the claimed invention. Also, the term "consisting of" can be used anywhere where the terms comprising, including, containing or having are used herein, but consistent of excludes any element, step, or ingredient not specified in a given claim where it is used.

Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, Z, X and Y, X and Z, Y and Z, or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

Additionally, in the subject description, the word "example" is used to mean serving as an example, instance, or illustration. Any embodiment or design described herein as "example" is not necessarily to be construed as preferred or advantageous over other embodiments or designs. Rather, use of the word example is intended to present concepts in a concrete manner. Accordingly, all such modifications are intended to be included within the scope of the present inventions. Other substitutions, modifications, changes, and omissions may be made in the design, operating conditions, and arrangement of the preferred and other example embodiments without departing from scope of the present disclosure or from the spirit of the appended claims.

What is claimed is:

1. A protective footwear, comprising:

a foot engagement portion;

a lower-leg engagement portion;

a closure assembly configured to facilitate at least partially securing the protective footwear to a leg of a wearer;

a core disposed within the foot engagement portion and the lower-leg engagement portion; and a pivotal hinge system positioned to pivotally couple the lower-leg engagement portion to the foot engagement portion; wherein the pivotal hinge system limits rotational movement of the lower-leg engagement portion relative to the foot engagement portion about a set range of motion, the pivotal hinge system comprising: an ankle dampening system coupled with the pivotal hinge system and configured to allow for additional rotational movement of the lower-leg engagement portion relative to the foot engagement portion beyond a limit of the set range of motion, the ankle dampening system comprising:

a support having a recess; and a hinge bumper configured to reside within the recess and limit an amount of the additional rotational movement of the lower-leg engagement portion relative to the foot engagement portion beyond the limit of the set range of motion;

wherein the lower-leg engagement portion includes an exoskeleton defining a plurality of apertures, the plurality of apertures positioned such that at least a portion of the core is exposed to an external environment.

2. The protective footwear of claim 1, wherein the lower-leg engagement portion defines a cable end interface and a buckle interface, and wherein the closure assembly includes a cable closure system, the cable closure system comprising:

a buckle assembly configured to releasably couple to the buckle interface; and a cable extending between the cable end interface and the buckle assembly, the cable having a first end coupled to the cable end interface and an opposing second end coupled to the buckle assembly.

3. The protective footwear of claim 2, wherein the buckle assembly includes a clasp and a ratchet strap, wherein the clasp is configured to releasably couple to the buckle interface, and wherein the opposing second end of the cable is coupled to the ratchet strap.

4. The protective footwear of claim 2, wherein the foot engagement portion defines a second cable end interface and the lower-leg engagement portion or the foot engagement portion defines a second buckle interface.

5. The protective footwear of claim 4, further comprising a second cable closure system configured to facilitate at least partially securing the protective footwear to the leg of the wearer, the second cable closure system comprising:

a second buckle assembly configured to releasably couple to the second buckle interface; and a second cable extending between the second cable end interface and the second buckle assembly, the second cable comprising a first end coupled to the second cable end interface and an opposing second end coupled to the second buckle assembly.

6. The protective footwear of claim 2, wherein the buckle assembly comprises:

a clasp; and a ratchet strap, wherein the clasp is configured to releasably couple to the buckle interface and the opposing second end of the cable is coupled to the ratchet strap.

7. The protective footwear of claim 2, wherein the closure assembly further includes a cable guide positioned to receive an intermediate portion of the cable.

8. The protective footwear of claim 1, further comprising a ventilation system including:

an intake vent disposed within a toe portion of the foot engagement portion and positioned to receive an inlet airflow from the externa environment;

an exhaust vent disposed within a heel portion of the foot engagement portion and positioned to provide an exit airflow to the external environment; and an airflow conduit extending between the intake vent and the exhaust vent, the airflow conduit defining one or more slots positioned to facilitate the entry of the inlet airflow from the intake vent into an internal cavity of the foot engagement portion and facilitate the exit of the exit airflow from the internal cavity of the foot engagement portion through the exhaust vent.

9. The protective footwear of claim 1, further comprising a shank disposed within a sole of the foot engagement portion, the shank including:

a plate positioned to extend along a bottom of a foot of the wearer;

a sidewall extending from the plate and positioned to extend at least one of around a heel and along at least one side of an ankle of the wearer; and a dampening layer disposed within the plate.

10. The protective footwear of claim 9, wherein the plate and the sidewall are manufactured from at least one of carbon fiber, carbon fiber encapsulated with thermoplastic polyurethane, fiberglass, thermoplastic polyurethane, metal, steel, aluminum, titanium, a plastic material, and a composite material.

11. The protective footwear of claim 1, further comprising a shank disposed within a sole of the foot engagement portion, wherein the shank includes a hinge support positioned to extend along the at least one side of an ankle of the wearer, the hinge support configured to support the pivotal hinge system.

12. The protective footwear of claim 1, wherein the ankle dampening system is configured to allow for adjustment of an amount of rotational movement of the lower-leg engagement portion relative to the foot engagement portion.

13. The protective footwear of claim 1, wherein the core comprises a closure element.

14. The protective footwear of claim 13, wherein the closure element comprises one or more of a zipper and a lacing system.

15. The protective footwear of claim 1, further comprising one or more rubber sections disposed along a medial side of the lower-leg engagement portion and the foot engagement portion.

16. The protective footwear of claim 1, wherein the lower-leg engagement portion defines a band interface that extends from a first portion of the lower-leg engagement portion, and further comprising a band closure system including an elastic band coupled to a second portion of the lower-leg engagement portion, wherein the elastic band is configured to releasably engage with the band interface to selectively close the first portion and the second portion of the lower-leg engagement portion together around the leg of the wearer.

17. The protective footwear of claim 1, wherein the lower-leg engagement portion has a first portion and a second portion, wherein the second portion is at least partially separated from the first portion, the first portion defining a band interface extending from the first portion, and the second portion defining a first band coupler and a second band coupler; and a band closure system including:

a first flexible band having a first end configured to couple to the first band coupler and having an opposing second end;

a second flexible band having a first end configured to couple to the second band coupler and having an opposing second end; and a retainer coupling the opposing second end of the first flexible band to the opposing second end of the second flexible band, wherein the retainer is configured to releasably engage with the band interface to selectively close the first portion and the second portion of the lower-leg engagement portion together around the leg of the wearer of the footwear.

* * * * *